US010186108B2

(12) United States Patent
Moskowitz

(10) Patent No.: US 10,186,108 B2
(45) Date of Patent: Jan. 22, 2019

(54) WAGERING GAME APPARATUSES, METHODS AND SYSTEMS FOR SLOT GAMES WITH A "21" THEME AND VIDEO THREE CARD POKER FEATURING MULTIPLE PAY LINES WITH PROGRESSIVE JACKPOTS

(71) Applicant: Ahmnon D. Moskowitz, Rockville, MD (US)

(72) Inventor: Ahmnon D. Moskowitz, Rockville, MD (US)

( * ) Notice: Subject to any disclaimer, the term of this patent is extended or adjusted under 35 U.S.C. 154(b) by 0 days.

(21) Appl. No.: 15/657,811

(22) Filed: Jul. 24, 2017

(65) Prior Publication Data

US 2017/0323520 A1 Nov. 9, 2017

Related U.S. Application Data

(63) Continuation-in-part of application No. 15/162,541, filed on May 23, 2016, now Pat. No. 9,965,924, which is a continuation-in-part of application No. 14/332,351, filed on Jul. 15, 2014, now Pat. No. 9,898,895.

(60) Provisional application No. 62/165,870, filed on May 22, 2015, provisional application No. 61/846,608, filed on Jul. 15, 2013.

(51) Int. Cl.
*G07F 17/34* (2006.01)
*G07F 17/32* (2006.01)

(52) U.S. Cl.
CPC ..... *G07F 17/3213* (2013.01); *G07F 17/323* (2013.01); *G07F 17/3209* (2013.01); *G07F 17/3244* (2013.01); *G07F 17/3246* (2013.01); *G07F 17/3262* (2013.01); *G07F 17/3276* (2013.01); *G07F 17/3293* (2013.01); *G07F 17/34* (2013.01)

(58) Field of Classification Search
None
See application file for complete search history.

(56) References Cited

U.S. PATENT DOCUMENTS

| | | | |
|---|---|---|---|
| 3,796,433 | A | 3/1974 | Fraley et al. |
| 4,339,134 | A | 7/1982 | Macheel |
| 4,380,334 | A | 4/1983 | Minkoff et al. |
| 5,154,429 | A | 10/1992 | LeVasseur |

(Continued)

FOREIGN PATENT DOCUMENTS

WO 2004015529 A2 2/2004

OTHER PUBLICATIONS

Allen Chan, National Search Report U.S. Appl. No. 14/332,351 dated May 12, 2016.

(Continued)

*Primary Examiner* — Ronald Laneau
(74) *Attorney, Agent, or Firm* — The Roy Gross Law Firm, LLC; Roy Gross

(57) ABSTRACT

Methods, systems and apparatuses of and for playing electronic or electro-mechanical wager gaming devices, including a player interface, of and for playing a "slot machine", "rotary reel", or "video poker" type game based at least in part upon card-deck games such as but not limited to blackjack and/or poker. The methods, systems and apparatuses include a plurality of configurations with multiple rule sets and payout lines to facilitate the inducement and build game player excitement.

21 Claims, 25 Drawing Sheets

(56) References Cited

U.S. PATENT DOCUMENTS

| | | | | |
|---|---|---|---|---|
| 5,257,789 | A | 11/1993 | Levasseur | |
| 5,395,119 | A | 3/1995 | Jacob et al. | |
| 5,605,334 | A | 2/1997 | McCrea, Jr. | |
| 5,791,991 | A | 8/1998 | Small | |
| 5,823,873 | A | 10/1998 | Moody | |
| 6,581,937 | B1 | 6/2003 | Crisswell | |
| 7,367,564 | B2 | 5/2008 | Latell | |
| 7,591,728 | B2 * | 9/2009 | Gioia | A63F 1/00 273/138.1 |
| 7,758,411 | B2 | 7/2010 | Crawford, III et al. | |
| 7,785,184 | B2 | 8/2010 | Jubinville et al. | |
| 7,824,254 | B2 | 11/2010 | Dunaevsky et al. | |
| 9,257,006 | B2 * | 2/2016 | Gagner | G07F 17/323 |
| 9,286,747 | B2 | 3/2016 | Chang | |
| 9,552,701 | B2 | 1/2017 | Pececnik | |
| 2002/0111205 | A1 | 8/2002 | Beavers | |
| 2003/0027621 | A1 | 2/2003 | Libby | |
| 2004/0015529 | A1 | 6/2004 | Tanrikulu et al. | |
| 2004/0176155 | A1 | 9/2004 | Gold et al. | |
| 2007/0120320 | A1 | 5/2007 | Miltenberger et al. | |
| 2007/0135203 | A1 | 6/2007 | Nicely | |
| 2008/0076572 | A1 | 3/2008 | Nguyen et al. | |
| 2009/0121434 | A1 | 5/2009 | Baerlocher et al. | |
| 2009/0295087 | A1 | 12/2009 | Kling et al. | |
| 2010/0078892 | A1 | 4/2010 | Gore | |
| 2010/0261515 | A1 | 10/2010 | Tobias et al. | |
| 2010/0298039 | A1 | 11/2010 | Dunaevsky et al. | |
| 2011/0057390 | A1 | 3/2011 | Scalisi | |
| 2011/0140359 | A1 | 6/2011 | Polynice | |
| 2013/0102381 | A1 | 4/2013 | Nelson et al. | |
| 2016/0379443 | A1 | 12/2016 | Abbott | |
| 2017/0046910 | A1 * | 2/2017 | Sherrets | G07F 17/3213 |
| 2017/0345257 | A1 * | 11/2017 | Gagner | G07F 17/326 |

OTHER PUBLICATIONS https://en.wikipediaorg/wiki/Catch_21. Accessed Dec. 1, 2017.
https://play.google.com/store/apps/details?id=air.com.differencegames.towerof21free. Accessed Dec. 1, 2017.
http://www.gsn.cornigames/free/catch21/. Accessed Dec. 1, 2017.

* cited by examiner

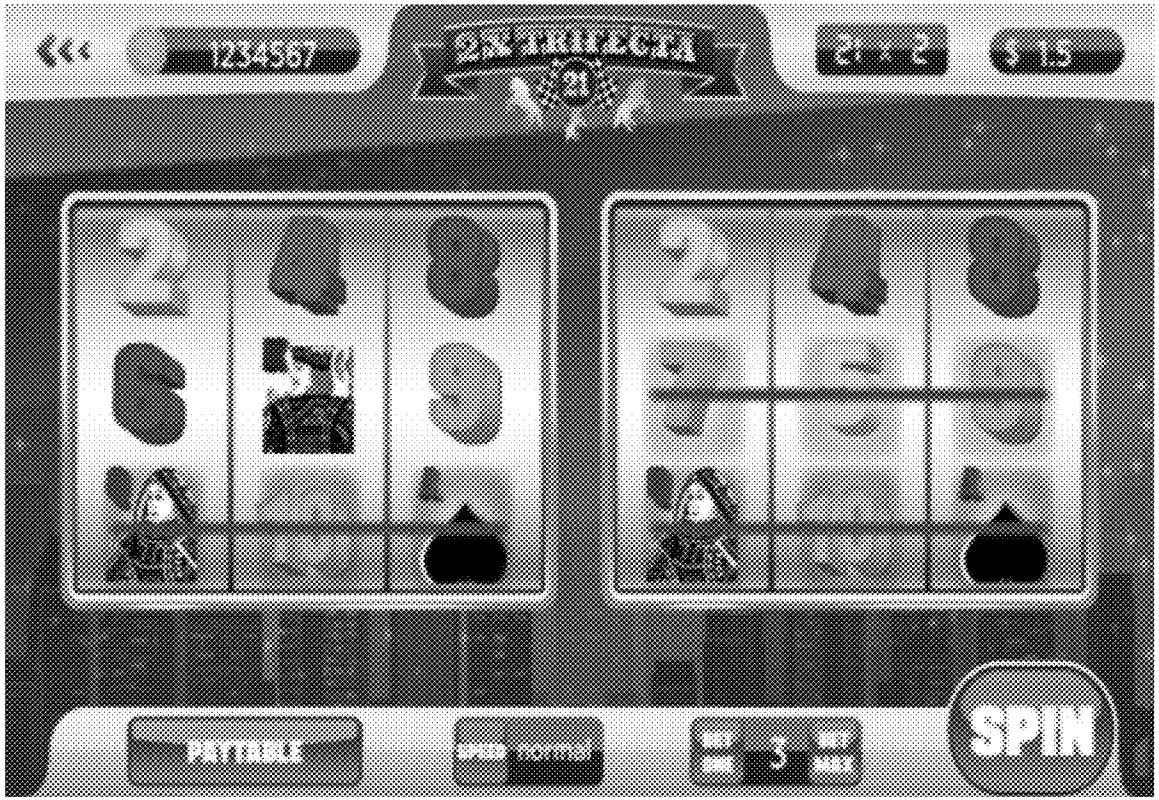
SPIN
PAUSE
PAUSE
PAUSE

| | | | |
|---|---|---|---|
| 21x1 | 0.05 | 0.1 | 0.15 |
| 21x2 | $0.50 | $1.00 | $1.50 |
| 21x3 | $10.00 | $20.00 | $30.00 |
| 21x4 | $100.00 | $200.00 | $300.00 |
| 21x5 | $1,000.00 | $2,000.00 | $3,000.00 |
| 21x6 | 10,000 | $20,000.00 | $30,000.00 |

FIG 9C

Double line Bonus

| | Bet $1 | Bet $2 | Bet $3 |
|---|---|---|---|
| Six card royal flush | 100,000 | 200,000 | 3,000,00 |
| Six card straight flush | 10,000 | 20,000 | 30,000 |
| Five card royal flush | 200 | 400 | 6,000 |
| Five card straight flush | 50 | 100 | 150 |
| Four of a kind | 10 | 20 | 30 |
| Full house | 2 | 4 | 6 |
| Five card flush | 1.5 | 3 | 4.5 |
| Five card straight | 1 | 2 | 3 |

The Best possible combination of two of the lines is used to calculate the Double line Bonus

Fig. 12C

Super 9 Bonus

| | Bet $1 | Bet $2 | Bet $3 |
|---|---|---|---|
| Super nine straight flush | 100,000 | 200,000 | 5,000,000 |
| Super nine Flush | 1,000 | 2,000 | 3,000 |
| Super nine straight | 500 | 1,000 | 1,500 |
| Eight card royal flush | 10,000 | 20,000 | 30,000 |
| Eight card straight flush | 1,000 | 2,000 | 3,000 |
| Seven card royal flush | 500 | 1,000 | 1,500 |
| Seven card Straight flush | 100 | 200 | 300 |

Super 9 bonus: all nine cards are used to calculate the winners

Fig. 12D

| | Bet $1.2 | Bet $2.4 | Bet $3.6 |
|---|---|---|---|
| Royal flush exact order hearts | $500 | $1,000 | $1,500 |
| Royal flush | $10 | $20 | $30 |
| Straight flush | $4 | $8 | $12 |
| Three of a kind | $3 | $6 | $9 |
| Straight | $0.5 | $1 | $1.5 |
| Flush | $0.4 | $0.8 | $1.2 |
| Pair Jack or better | $0.1 | $0.2 | $0.3 |
| Pays from left to right | | | |

Fig. 13B

WAGERING GAME APPARATUSES, METHODS AND SYSTEMS FOR SLOT GAMES WITH A "21" THEME AND VIDEO THREE CARD POKER FEATURING MULTIPLE PAY LINES WITH PROGRESSIVE JACKPOTS

CROSS-REFERENCE TO RELATED APPLICATIONS

This application is a continuation-in-part Application, for which priority is claimed under 35 U.S.C. § 120, of co-pending U.S. patent application Ser. No. 14/332,351, filed Jul. 15, 2014, entitled "METHODS, SYSTEMS, AND APPARATUS FOR PLAYING POKER, BLACKJACK AND BACCARAT," which is a non-provisional application, for which priority is claimed under 35 U.S.C. § 119, of U.S. Provisional Patent Application No. 61/846,608, filed Jul. 15, 2013, entitled "METHODS, SYSTEMS, AND APPARATUS FOR PLAYING POKER, BLACKJACK AND BACCARAT."

This application also is a continuation-in-part application, for which priority is claimed under 35 U.S.C. § 120, of co-pending U.S. patent application Ser. No. 15/162,541, filed on May 23, 2016, entitled "METHODS, SYSTEMS, AND APPARATUS FOR PLAYING MULTI-ZONE 21, which is a non-provisional application, for which priority is claimed under 35 U.S.C. § 119, of U.S. Provisional Patent Application No. 62/165,870, filed on May 22, 2015, entitled "METHODS, SYSTEMS, AND APPARATUS FOR PLAYING MULTI-ZONE 21.

The entire contents of the above identified patent applications are hereby incorporated by reference in their entirety.

FIELD OF THE INVENTION

The present invention relates to methods and systems of and for playing a gaming or casino type game. More specifically, the present invention relates to methods and systems of and for playing a so-called "slot machine", "rotary reel", or "rotary wheel" type game based at least in part upon card-deck games such as but not limited to blackjack and/or poker.

BACKGROUND OF THE INVENTION

So-called slot-machines, one-arm-bandits, and similar "rotary wheel" or "rotary reel" type (hereinafter "slots" or "reels") wagering games at their inception were mechanical devices and the staple of most casinos and other entertainment industries throughout most the twentieth century. As such industries expanded and evolved toward the later portion of the 1900s, purely mechanical systems were replaced with those of primarily electro-mechanical configuration. Modernly, slots are now predominantly fully digital computer based systems and referred to in the gaming industry as an "electronic gaming device" (herein "EGD"). Fundamentally, EGDs comprise software stored in a memory and executed on or by a processor which presents a graphical user interface (or "interface") to a player to enable, control, and facilitate game play. Such modern slots or reels comprise and range from rows-and-rows of cabinet housed stand-alone or networked EGDs placed in casinos or other gaming or entertainment establishments or locations, to a single stand-alone slot at a remote truck stop or convenience store, and further to a rather simple software application executing on a player's computer, smart-phone, or other personal computing device.

A core fundamental of most modern EDGs is a virtual software created and processor controlled random number generator used to determine a rotary reel stop position. Randomness may be defined as a lack of predictability or pattern in events; and, without utilizing some type of randomization, such systems or games would be "rigged" in that each play or outcome would be predetermined in some way by the designer and thus "rigged" by those offering such wagering game to the public. Such an uttering may rise to the standard of grand-theft and fraud.

Relating to computer science and engineering, a random number generator typically outputs of a sequence of numbers or symbols that cannot be reasonably predicted more accurately than by random chance. Several computational methods for random-number generation exist; but many fall short of true randomness based on the available permutations. More advanced systems meet or exceed the common statistical tests for true unpredictability. Such carefully designed cryptographically secure computational based methods of generating random numbers may be based on the Yarrow algorithm, the Fortuna pseudorandom number generator; or others. Computational randomness can be created at the virtual intersection of game theory and algorithmic design; which in the inventive field brings into play, card-play and the Nash equilibrium.

The Nash equilibrium is a foundational concept within game theory which can test the randomness of any given gaming system. If Nash equilibria is established and maintained in a system, then the system or game is unbiased toward any player or group of players and is therefore in "semi-perfect chaos" and therefore "fair".

Typically, as related to slots, a displayed number, symbol, color, or other visual representation is determined or selected using a random number generator, or is determined by random number generator data with visual representations being assigned afterwards. For example, after a player actuates an EGD by placing or selecting a wager and/or pulling a lever or pressing a button (either physically or virtually via a player interface) the processor "spins the reel" using the random number generator to land on a symbol or value determined at least in part according to the output of a random number generator. Game play is determined by the processor using a random number generator output directly, and/or determinations based upon a rule set which ultimately dictates and determines game play outcomes.

As a further example, after a player actuates an EGD, colloquially known as a "video slot", by placing or selecting a wager and/or pulling a lever, pressing a button, or the like; a processor then "spins the reel" to a symbol or value in direct or semi-direct accordance with the output of a random number generator. A player may win by matching identical symbols, sometimes with substitutes, or wilds within a "payline". After a player wins the system or machine is credited with the win which enables continued play, or a player may "cash out" their winnings.

So-called "video poker slots" are also a staple of most casinos. However, a three-card poker based, jackpot win system, tends to be unpopular because there are few payouts lucrative enough to attract many players.

There is an absence of slot games with a blackjack or 21 theme. There is an absence of slot games where a player wins with a numerical objective. There is an absence of slot games for 21 with multiple paylines with a 21 theme or a 21 numerical objective.

It is desired to provide a method and system to overcome the above-mentioned disadvantages in the prior art.

SUMMARY OF THE INVENTION

It is an object of the present invention to provide a method and system to augment video slot machines and other EGDs by utilizing the additional gaming and statistical odds of playing and winning card based games such as but not limited to poker and blackjack.

It is an object of the present invention to provide a method and system to augment video slot machines and other EGDs by utilizing the additional statistical odds of playing card based games such as poker and blackjack.

It is an object of the present invention to provide a method and system to augment video slot machines and other EGDs by utilizing the additional statistical odds of playing card based games such as poker or blackjack including more than one payout line.

These and other objects of the invention are achieved by providing a gaming system comprising: at least one display device; at least one processor; and at least one memory device which stores a plurality of instructions, which when executed by the at least one processor, cause the at least one processor to: (a) display a player interface on the at least one display device, the player interface having a slot based visual representation including at least three actuation result locations based upon selections from a "playing card" deck and at least one pay-out-line indicating a win actuation result location; (b) upon actuation, update the at least three actuation result locations on the at least one display device based at least in part upon the output of a randomized number generator and at least one rule set; (c) calculate a point score based on the rule set if the at least three actuation result locations comprise a value that is twenty-one (21) counting in sequential order across the at least one pay-out-line; and (d) update an account based upon the point score.

Herein and hereby defined, "actuation result location" shall mean a single game activation, round, spin, or hand result position or location on a player interface to and of which the output of a random number generator is used in at least part to determine the outcome of and for the single game activation. For example, if a player interface consists of twelve actuation result locations, then a player interface may comprise a three-by-four, four-by-three, two-by-six, etc. game play and payout pattern configuration.

In certain embodiments, the system includes at least one input device.

In certain embodiments, the at least one input device is configured to accept real money or virtual money and is configured to accept a wager.

In certain embodiments, the point score is determined according to a predetermined table, wherein the point score designates a credit or deficit to the account.

In certain embodiments, the account is a player account or game account.

In certain embodiments, the rotary reel based visual representation includes at least fifteen actuation result locations and at least three pay-out-lines wherein the at least one rule set is to have a twenty-one objective that uses numerical values based upon the Blackjack or Twenty-One card game.

In certain embodiments, there are five actuation result locations per pay-out-line.

In certain embodiments, if the sequential values in a pay-out-line total more than twenty-one (21) or are exactly twenty-one, a new starting point begins at the next sequential actuation result location allowing the possibility of two or more twenty-one (21) values within the pay-out-line.

In certain embodiments, the point score is based on the cumulative twenty-one (21) values across all of the pay-out-lines.

In certain embodiments, the point score is credited for having the at least three actuation result locations total less than twenty-one (21). In certain embodiments, the point score is credited for having the at least three actuation result locations total exactly twenty-one (21).

In certain embodiments, the point score is credited for having at least five actuation result locations total less than twenty-one (21). In certain embodiments, the point score is credited for having the at least five actuation result locations total exactly twenty-one (21).

In certain embodiments, an additional point score is provided for having two twenty-one's (21's) within a pay-out-line.

In certain embodiments, the at least one display device comprises a video display device housed within a cabinet.

In certain embodiments, a starting point S for a line is located on the left side of the video display device and/or player interface.

In certain embodiments, the player interface provides a bonus symbol.

In certain embodiments, the system is used for three card poker, and wherein the high payout for the game is based on a player receiving a Straight Flush in a specific order of a specific suit.

In certain embodiments, the rotary reel based visual representation includes at least six actuation result locations and wherein the at least one rule set is based upon the card game Poker.

Other objects of the invention are achieved by providing a gaming input device apparatus comprising: the gaming system as previously described; a wager input device; and a cash out device, wherein a payout is awarded to a player if they have exactly a twenty-one (21) value sequentially from left to right in a pay-out-line from the starting point.

In certain embodiments, the at least one rule set includes criteria for determining the account deficit or credit based at least in part upon the player actuation results.

In certain embodiments, the at least one rule set includes criteria for determining the account bonus based at least in part upon player actuation initiated game results.

Other objects of the invention are achieved by providing a method comprising: providing a wager input device having at least three reels, the plurality of reels being either mechanical reels or virtual reels, the plurality of reels comprising a starting point and an endpoint along pay-out-lines; inserting money or credit into the wager input device; initiating a game played on the wager input device with an actuation mechanism; determining whether a win of the game has occurred if the displayed plurality of reels comprise a value that is twenty-one (21) from the starting point counting in sequential order across a pay-out-line; and providing an award and/or payout based upon the win of the game.

Other objects of the invention are achieved by providing a wager input system comprising: at least one display device; at least one processor; and at least one memory device which stores a plurality of instructions, which when executed by the at least one processor, cause the at least one processor to: (a) display on the at least one display device, a player interface having at least two non-intersecting pay-out-lines from a game of three card poker; and (b) a rule set based on a calculation of a point score if the at least three actuation result locations comprise a value.

In certain embodiments, the system includes a pay-table that specifically indicates a high payout of Ace King Queen in a specific sequence of a specific suit.

In certain embodiments, the payout is progressive.

In certain embodiments, the pay-table has a high payout that involves a symbol that is not from a standard 52-card deck.

In certain embodiments, the at least one display device has an interface and wherein each half of the interface has a least two non-intersecting pay-out-lines.

In certain embodiments, the at least one display device has an interface and wherein the interface has four quadrants (I, II, III and IV) with each quadrant having at least two non-intersecting pay lines.

Other objects of the invention and its particular features and advantages will become more apparent from consideration of the following drawings and accompanying detailed description. It should be understood that the detailed description and specific examples, while indicating the preferred embodiment of the invention, are intended for purposes of illustration only and are not intended to limit the scope of the invention.

BRIEF DESCRIPTION OF THE DRAWINGS

FIG. 9A is illustrative of an inventive interface layout of a game described herein;

FIG. 9C is illustrative of a paytable of a game described herein;

FIG. 12C is illustrative of a paytable of a game described herein;

FIG. 12D is illustrative of a paytable of a game described herein;

FIG. 13B is illustrative of a paytable of a game described herein;

DETAILED DESCRIPTION OF THE INVENTION

In the following description, numerous details are set forth for the purpose of explanation. However, one of ordinary skill in the art will realize that the invention may be practiced without the use of these specific details.

Figure 1:
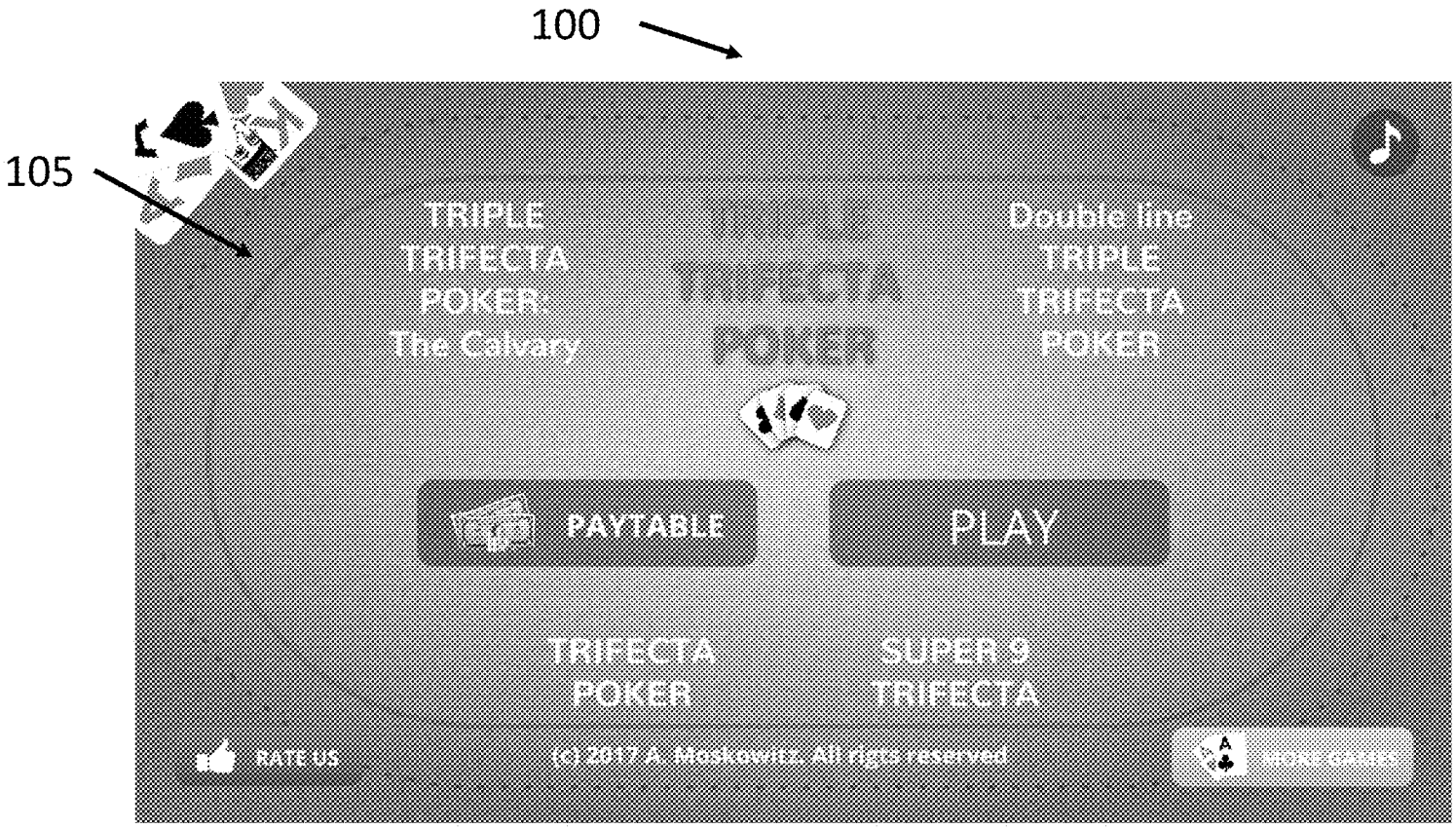
FIG. 1 is illustrative of an inventive interface layout of a game described herein.
Figure 2:
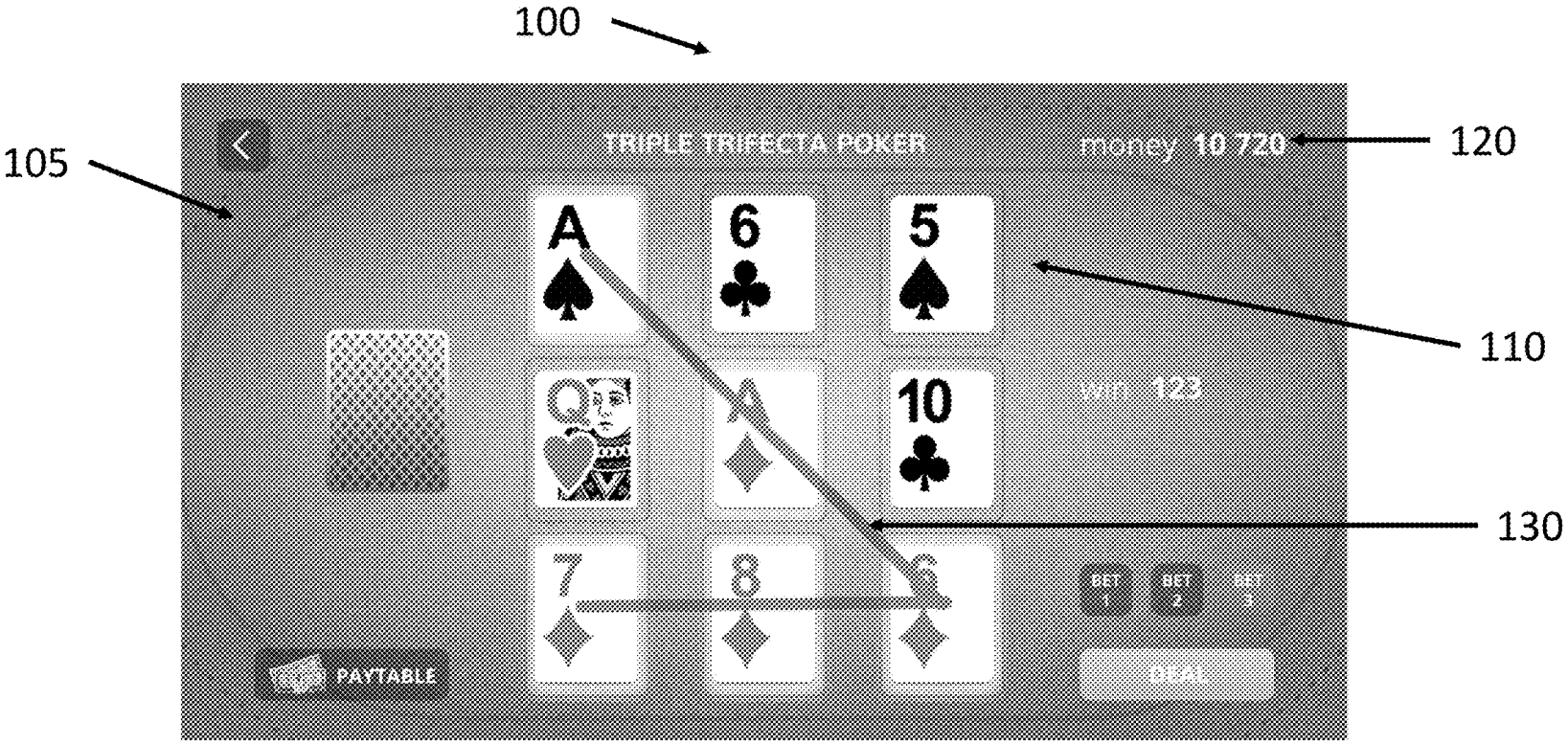
FIG. 2 is illustrative of an inventive interface layout of a game described herein.
Figure 3:
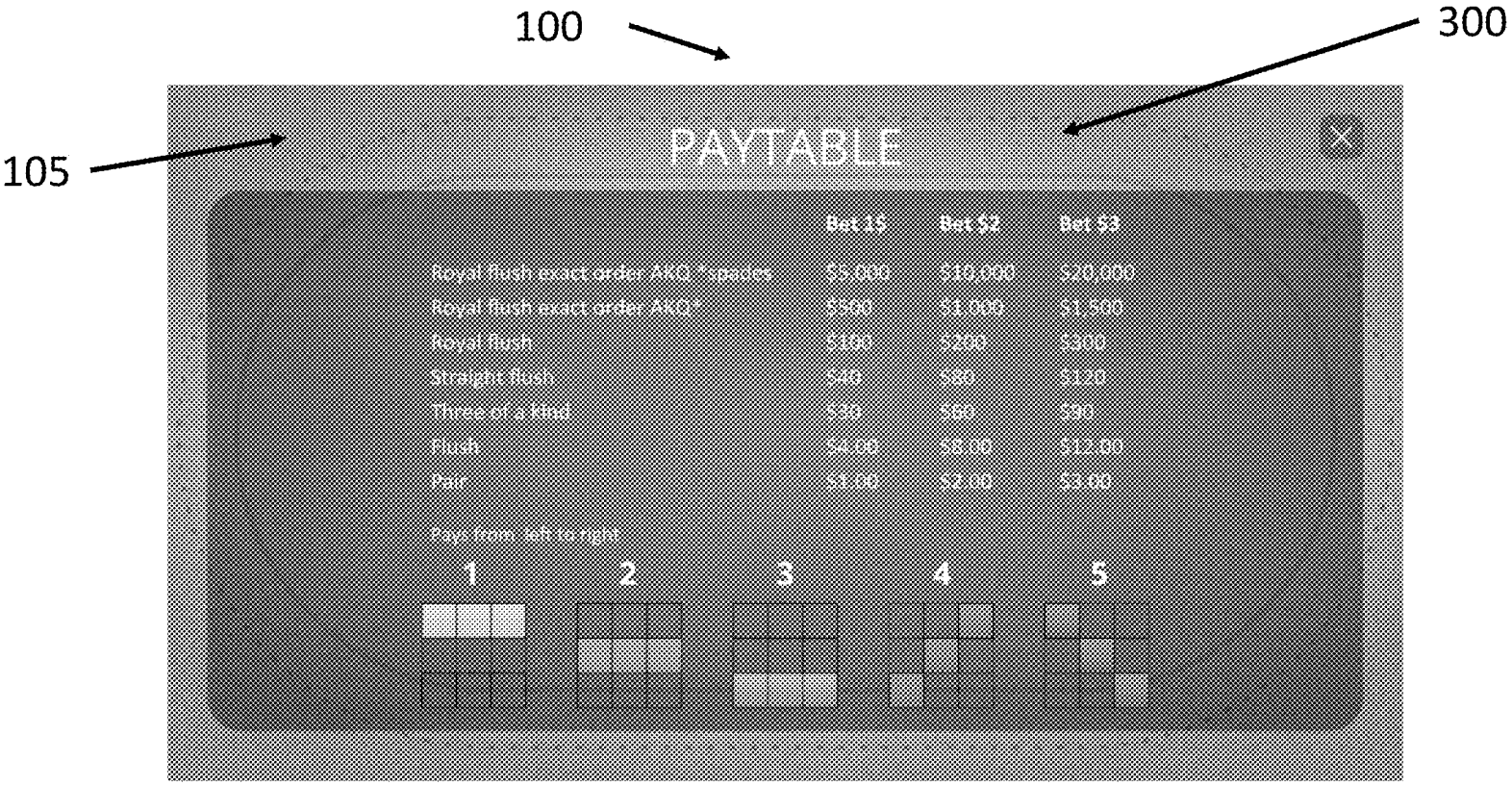
FIG. 3 is illustrative of a paytable of a game described herein.

As depicted in FIGS. 1 through 3, in one embodiment of the present invention is a game (100) including a play area (105) and three-card hands in play and may be called "Triple Trifecta Poker" and based upon a rule-set (Not Shown). The game (100) may use an actuation results location grid (110) including a three-card rule-set with high payout or progressive payout (120) if a player has three-cards of Ace, King, or Queen in a specific suit and/or in a specific order. Another rule-set embodiment may provide for a player to be awarded a payout (120) if three symbols are within a payline (130) and earns high or progressive payout (120) if all are of one symbol or suit. Lesser payouts (120) may be awarded for lesser quantities of a symbol or suit may also be provided. Other poker rule-set embodiments may include payouts (120) using poker hands with nine, eight, seven, six or five cards in play. One rule-set embodiment may be called "Super Trifecta Poker" and include twelve non-intersecting paylines (130) with six payouts (120). In one embodiment, six paylines may stretch from the center of an actuation results location grid (110) to the edges of a display or play area (105) to induce and build player excitement.

As depicted in FIG. 3, some embodiments of the inventive method and system is a game (100) which includes and determines awarded payouts (120) according to a predetermined paytable (300). The payout (120) variables may be chosen randomly or the results computed and the variables made to correspond to the output of a random number generator (Not Shown).

Figure 4:
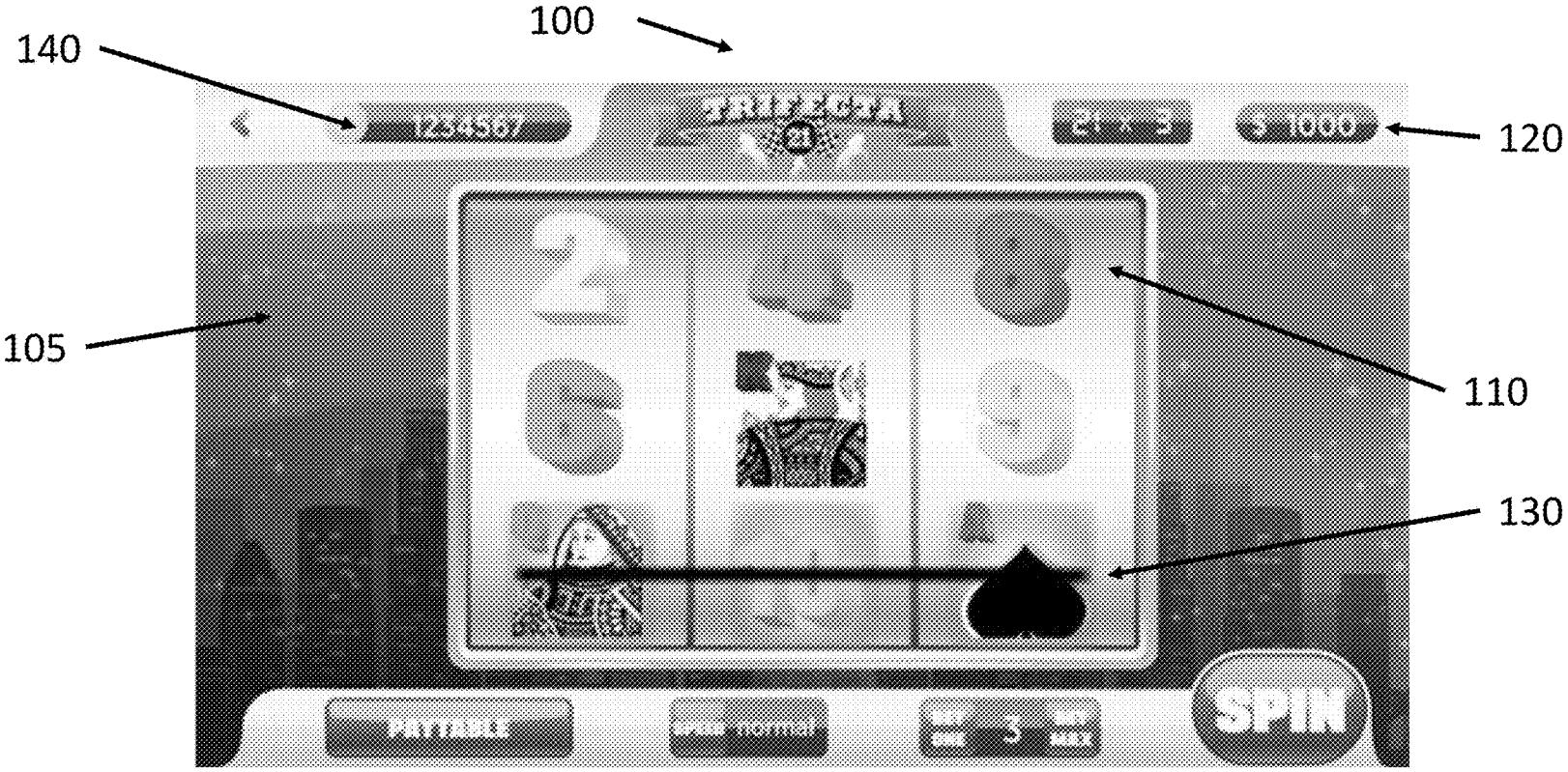
FIG. 4 is illustrative of an inventive interface layout of a game described herein.
Figure 5:
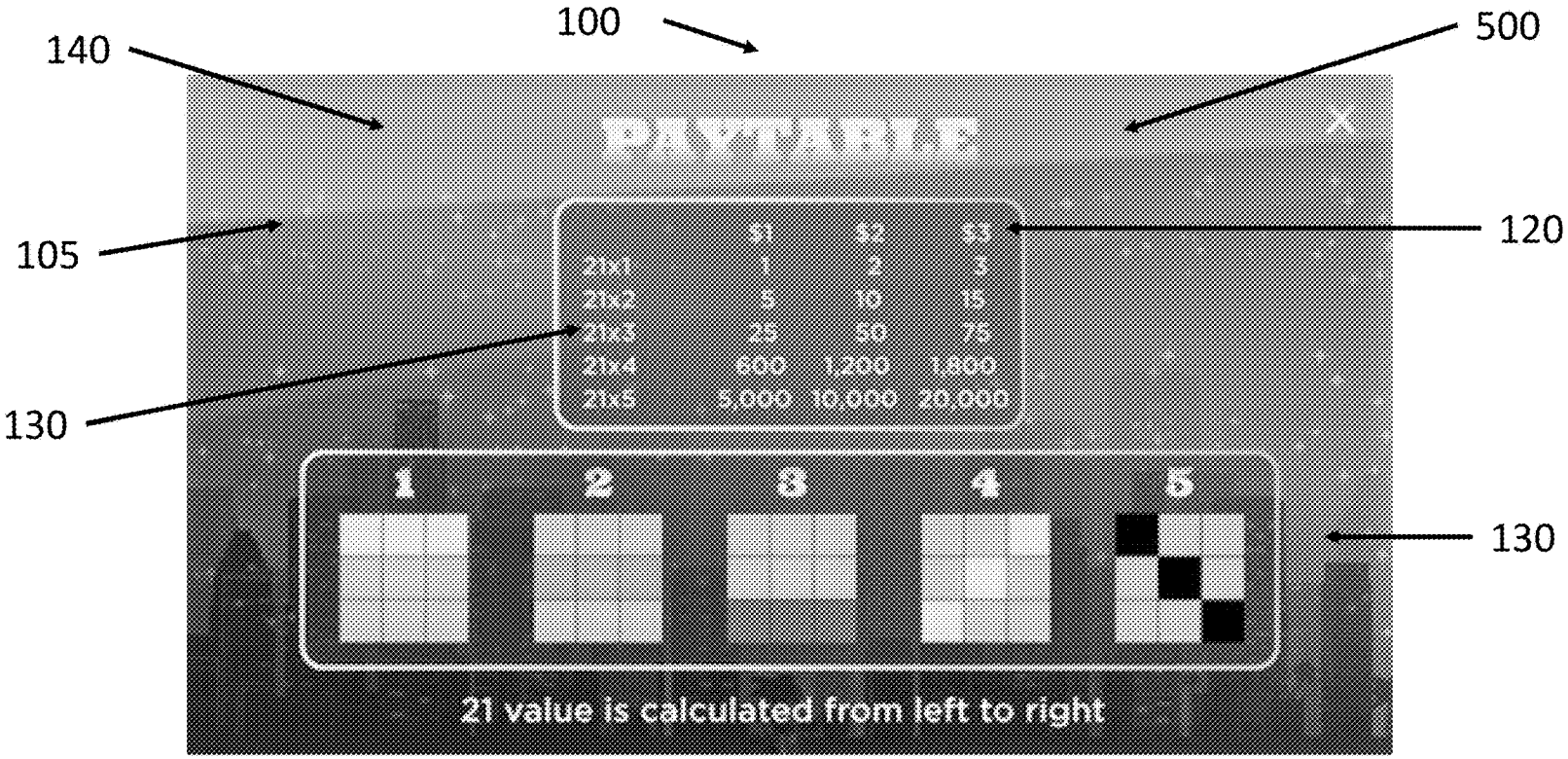
FIG. 5 is illustrative of a paytable of a game described herein.

As depicted in FIGS. 4 and 5, one embodiment of the present invention may be called "Trifecta 21" and may be played on a three-by-three actuation results location grid (110). A player may win by having a twenty-one value within a payline (130) according to a calculation made from variables (e.g. A or B from the starting point). As per a paytable (500), if a player has a twenty-one value they receive a point (140) and if not, a third card value is added to the first two and a calculation is made if the value of those three cards contain a twenty-one value. If so, points (140) are awarded. For consecutive points (140), a player's winnings (120) increases substantially. A payout (120) is awarded based on the cumulative probability of obtaining a twenty-one value within all paylines (130).

Figure 6A:
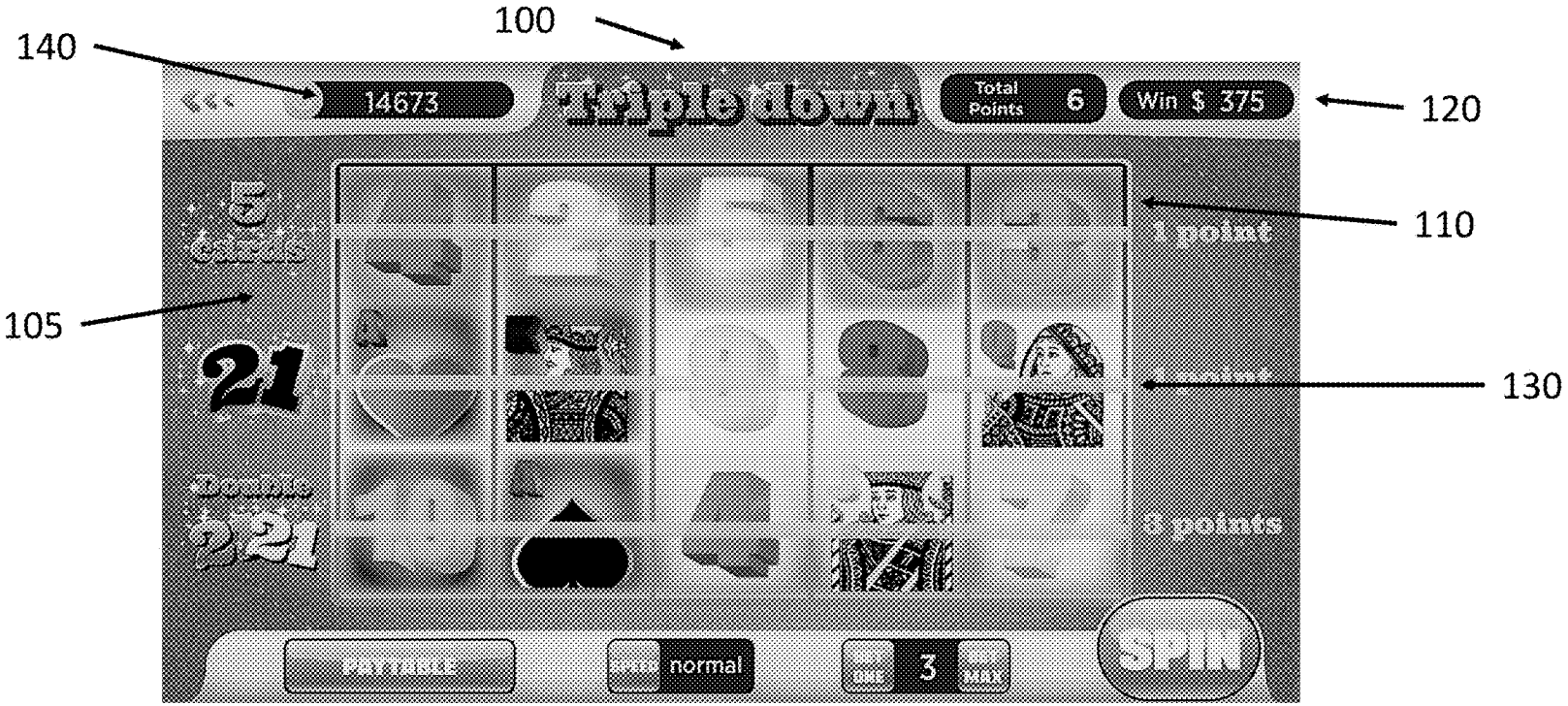
FIG. 6A is illustrative of an inventive interface layout of a game described herein.

As depicted in FIG. 6A, one embodiment of the present invention may include five reels, each reel displaying three values vertically. One possible game objective may be to draw a twenty-one value as many times as possible. As per a paytable (500) shown in FIG. 6B, if a player draws a twenty-one value they receive a point (140) and if not, a third card value is added to the first two and a calculation is made to determine if the value of those three cards contain a twenty-one value. If so, points (140) are awarded. For consecutive points (140), a player's winnings (120) increases substantially. A payout (120) is awarded based on the cumulative probability of obtaining a twenty-one value within all paylines (130). In such a game, it may be possible to draw up to two twenty-one values within a payline (130). A calculation may be made if the first two variables from the starting point contain a twenty-one value. If a player draws a twenty-one value, the player receives a point if not the third card value is added to first two and a calculation is made if the value of those cards equals twenty-one. If not, the counting continues with a fourth or fifth card. A player does not receive a point if they have a sequential value that is greater than twenty-one. If a payline (130) with all "five cards" has a total value under twenty-one, they are given a point. If the first two or three cards in a payline (130) contain a twenty-one value a point is awarded and a second S counting point begins. If a payline (130) contains two twenty-one values, a second point for the second twenty-one and a third bonus "Double 21" point for having two twenty-one within a payline (130). The payouts increase substantially with each consecutive point in the game. In certain embodiments, if a player has two 21 values within a payline they would receive an extra point in addition to the two points they received for the two 21 values.

The 21 values are calculated from left to right sequentially. If the first cards of a payline contain a 21 value they receive a point and the counting begins again with the next sequential card for that payline. If the first cards in a payline go over 21 they do not receive a point and the counting begins again at the next sequential card or symbol in the payline.

For example if a payline contained (7,7,7) as the first three values a point would be awarded and the count would begin once more. If the last two variables were an ace and a king two more points would be awarded. One point for the second 21 and a bonus double 21 for a line that contains two 21's known here as "double 21" bonus.

Another example; if a Payline contained (Q,K 9) for the first three variables no points would be awarded however the counting begins again for that payline, if the remaining variables are Jack and Ace the player would be awarded a point for that line. An example for five cards; if a player has (2,4,5,6,3) for a payline the player would receive a point. If a player had a 4 instead of the 3 as the last variable a player would have 21, two points for that line. In this game as a player receives more points the payout awards go up cumulatively.

Figure 6B:
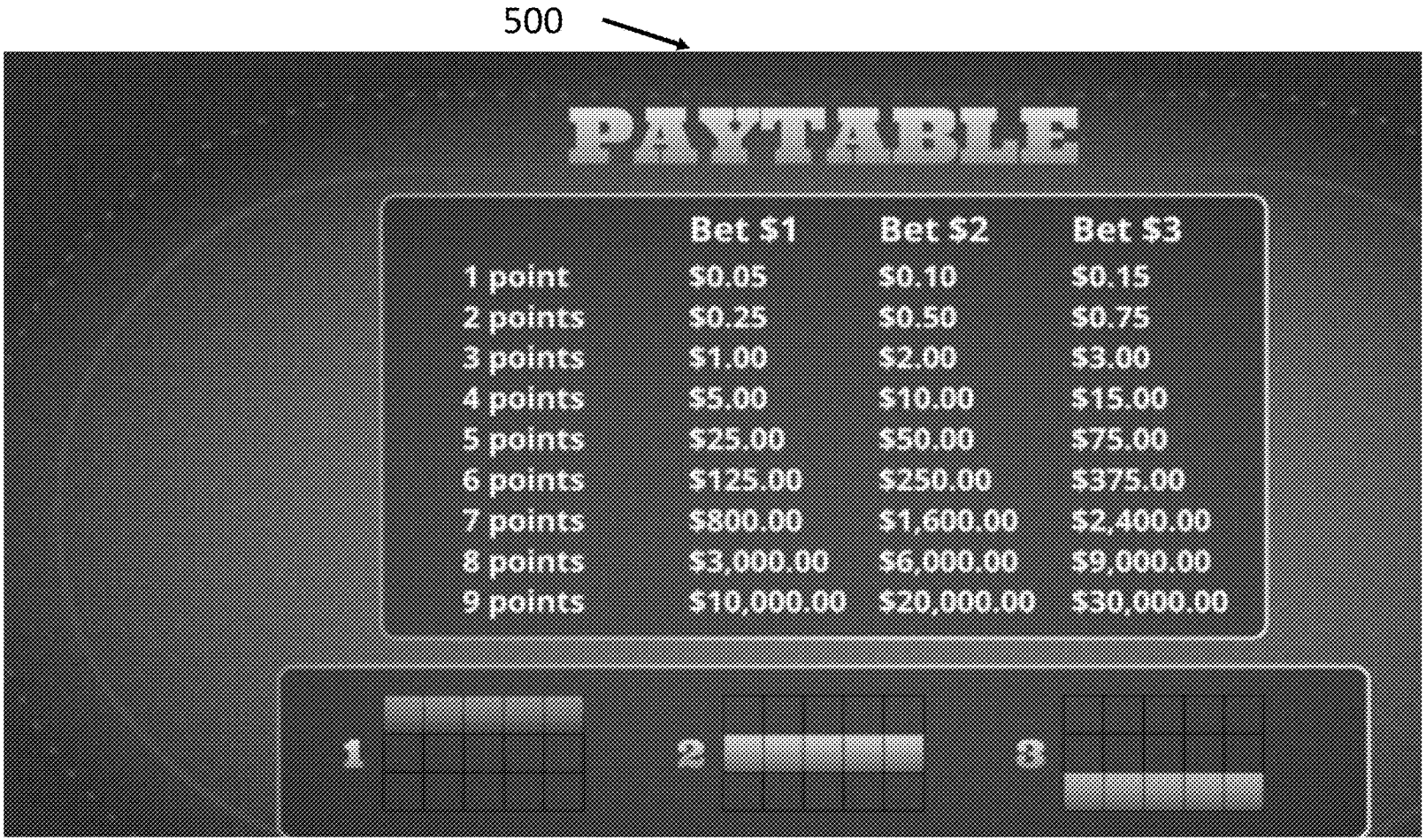
FIG. 6B is illustrative of a paytable of a game described herein.

FIG. 6B shows the paytable showing values associated with various winnings.

Figure 7A:
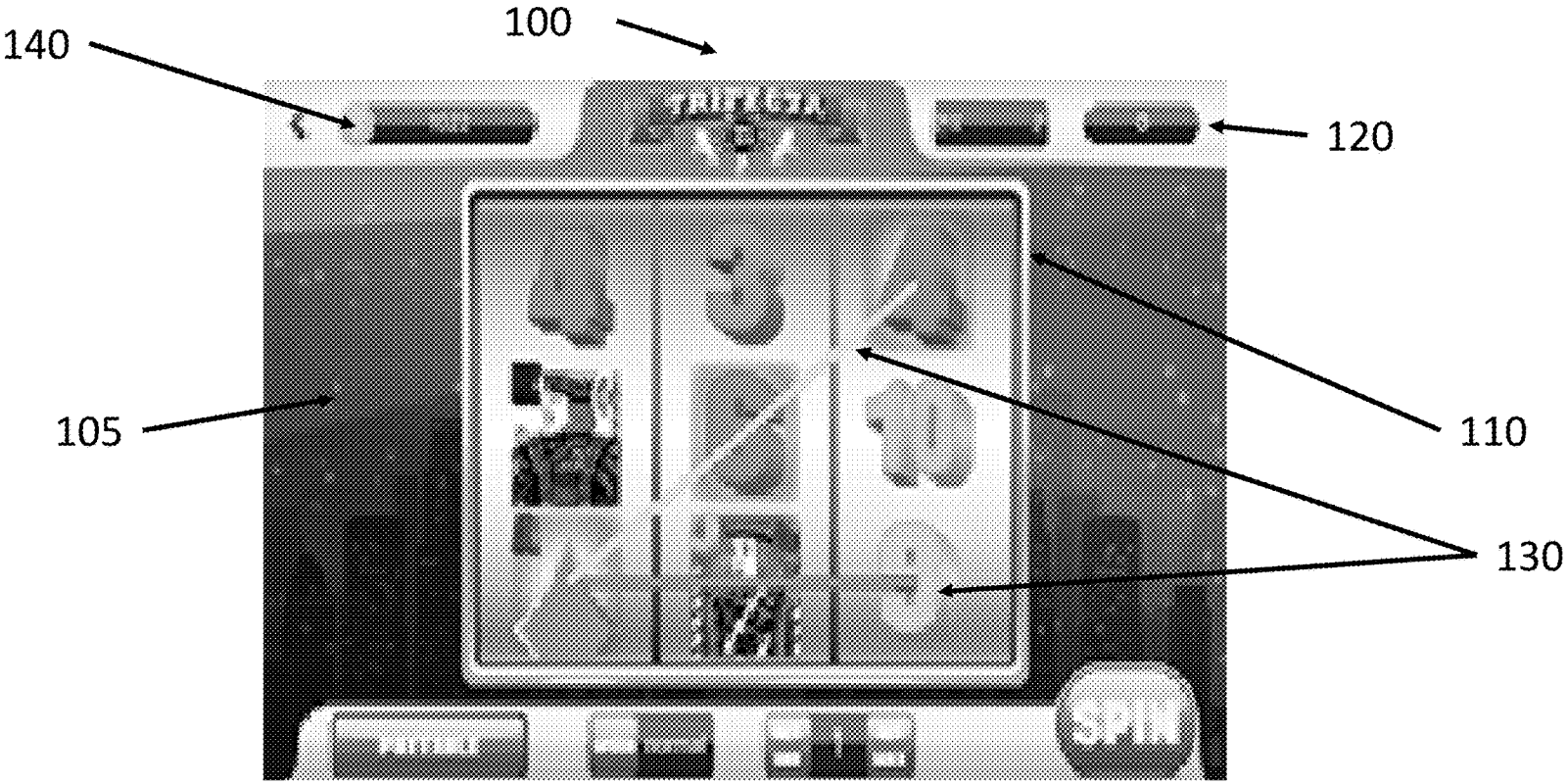
FIG. 7A is illustrative of an inventive interface layout of a game described herein.
Figure 7B:
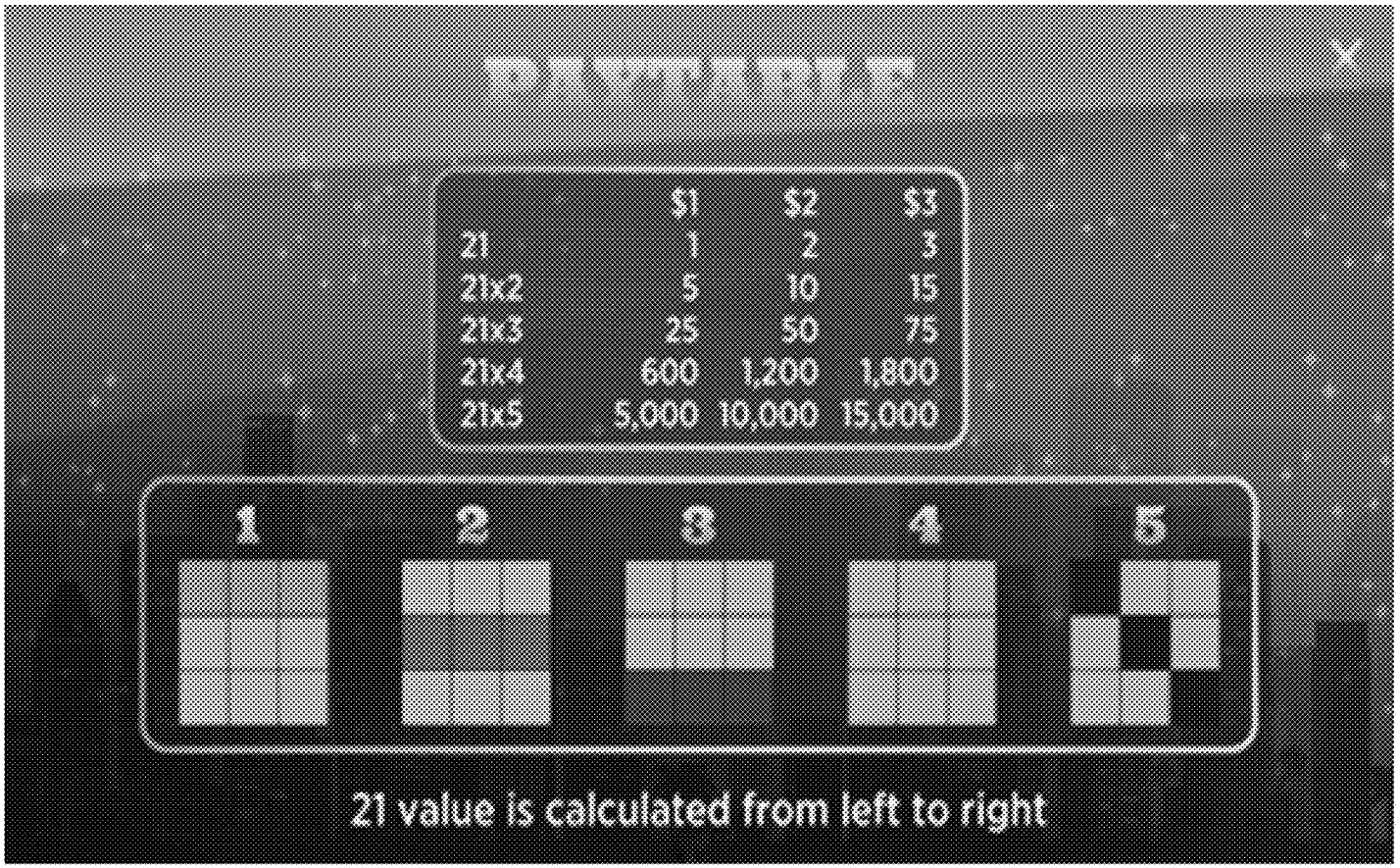
FIG. 7B is illustrative of a paytable of a game described herein.

FIG. 7A depicts an inventive game embodiment called "Trifecta 21"; which uses three reels, and unlike most other type games, a player wins based on the cumulative results of multiple paylines (130). Each reel has thirteen cards from a fifty-two card deck; but, may also contain other symbols. An Ace is a "one or eleven" value; King, Queen, Jack ten value; and all others face value. As depicted in FIG. 5, there may be five paylines (130), three horizontal and two diagonal. A player wins by having a twenty-one value within any payline (130). As can be appreciated from the paytable (500) the winnings increase substantially when more paylines (130) contain a twenty-one value. In this example, $1 is paid for a $1 bet, for a single payline (130) that contains a twenty-one value, and $5,000 is paid for having twenty-one values in all five paylines (130).

TABLE 1

| | | | |
|---|---|---|---|
| Line 1 | A | B | C |
| Line 2 | D | E | F |
| Line 3 | G | H | I |

As shown in Table 1 above, to calculate a win within a payline there are three lines 1, 2, 3 with three win starting points ADG. A winning value of twenty-one is calculated from left to right. For example, (A, K, 3) would be a win; however (3, K, A) would not. A calculation is made with the next variables BEH added to the first variables ADG. If a payline does not have a twenty-one value with the first two variables, the third variable/card in the payline is added to the first two. In the embodiment depicted in FIG. 7A, there are two twenty-one values within two separate paylines. GEC in the diagonal and GHI in the horizontal. In this example, since a player has a twenty-one value with the first two cards, the third card (9) is irrelevant for that payline. A player is awarded $5 for a $1 bet (ref. FIG. 5).

Figure 8:
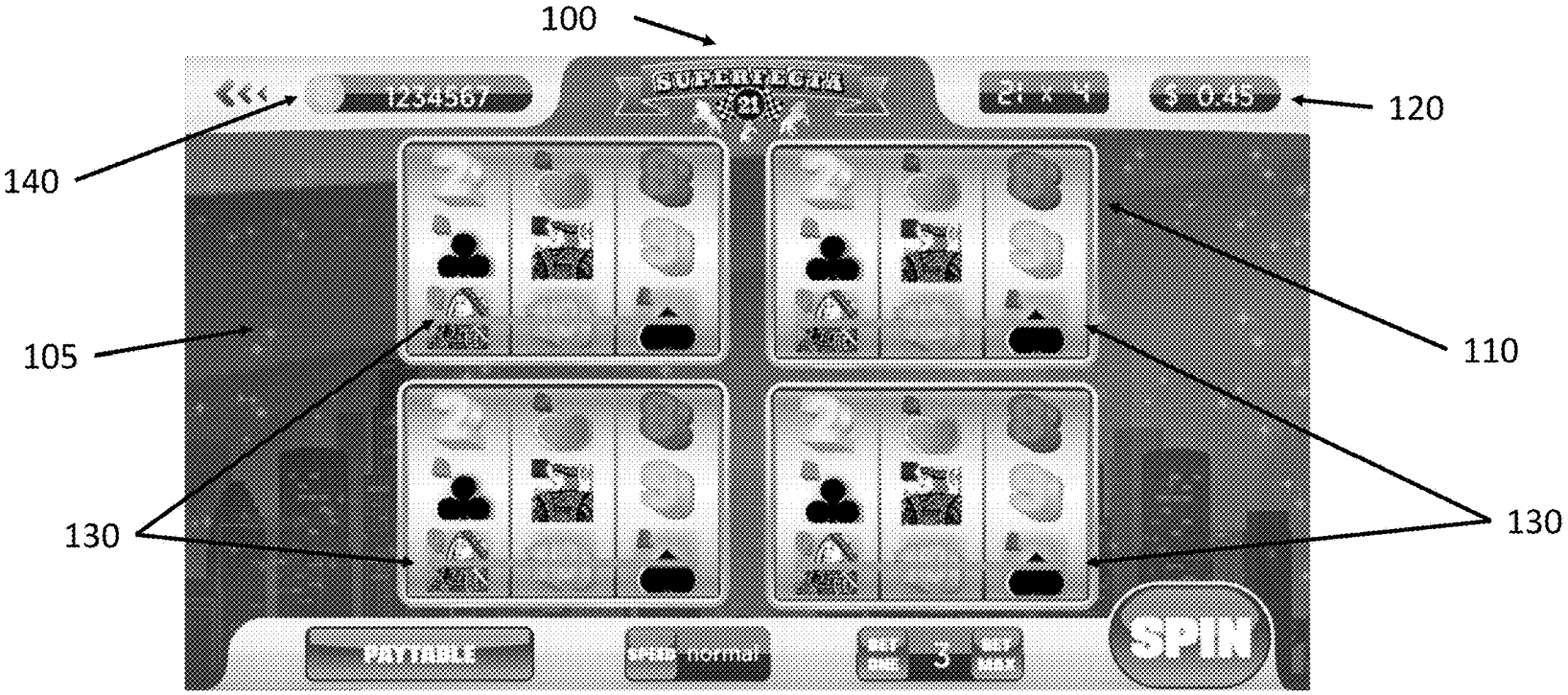
FIG. 8 is illustrative of an inventive interface layout of a game described herein.

As depicted in FIG. 8 and Tables 2 and 3 below, an inventive embodiment of a game (100) may be called "Supertrifecta 21". There are twelve starting points ADG for the lines one through twelve and twelve endpoints CFI. In this game, each of the twelve reels contain three Aces and the 4, 5, and 6 cards are removed to increase the odds of drawing a twenty-one. A player who wagers three dollars and would win $0.30 according to paytable Table 3. As can be understood and appreciated, the payouts increase substantially for every line containing a twenty-one value; with $30,000 paid for a $3 bet and having all twelve lines a twenty-one value.

TABLE 2

| | | | | | | | |
|---|---|---|---|---|---|---|---|
| Line 1 | A | B | C | Line 4 | A | B | C |
| Line 2 | D | E | F | Line 5 | D | E | F |
| Line 3 | G | H | I | Line 6 | G | H | I |
| Line 7 | A | B | C | Line 11 | A | B | C |
| Line 8 | D | E | F | Line 12 | D | E | F |
| Line 9 | G | H | I | Line 13 | G | H | I |

TABLE 3

| | Bet $1.00 | Bet 2.00 | Bet 3.00 |
|---|---|---|---|
| 21 × 1 | .01 | .02 | .03 |
| 21 × 2 | .03 | .06 | .09 |
| 21 × 3 | 0.05 | 0.1 | 0.15 |
| 21 × 4 | $ 0.1 | $ 0.20 | $ 0.30 |
| 21 × 5 | $ 0.25 | $ .50 | $ 1.50 |
| 21 × 6 | $ 1.00 | $ 2.00 | $ 3.00 |
| 21 × 7 | $ 5.00 | $ 10.00 | $ 15.00 |
| 21 × 8 | $ 10.00 | $ 20.00 | $ 30.00 |
| 21 × 9 | $ 100 | $ 200 | $ 300 |
| 21 × 10 | 1,000 | 2,000 | 3,000 |
| 21 × 11 | 3,000 | 6,000 | 90,000 |
| 21 × 12 | $10,000.00 | $20,000.00 | $30,000.00 |

As depicted in FIG. 9A, the "doubletrifecta 21" is shown. Here there are 6 reels or two grids, each grid having three horizontal paylines, a total of six paylines. There are six starting points; 1A, 2D, 3G and to the right side (4A, 5D, and 6G). There are also endpoints where the counting stops; C F and I for each line. In this game, a player inserted money and bet a dollar and obtained a 21 value in three lines, 4, 7 and 8. A player would receive a cash prize of $30 for the $3 wagered according to the paytable. The player can be given a receipt for a cash voucher or use the credit to continue playing.

Figure 9B:
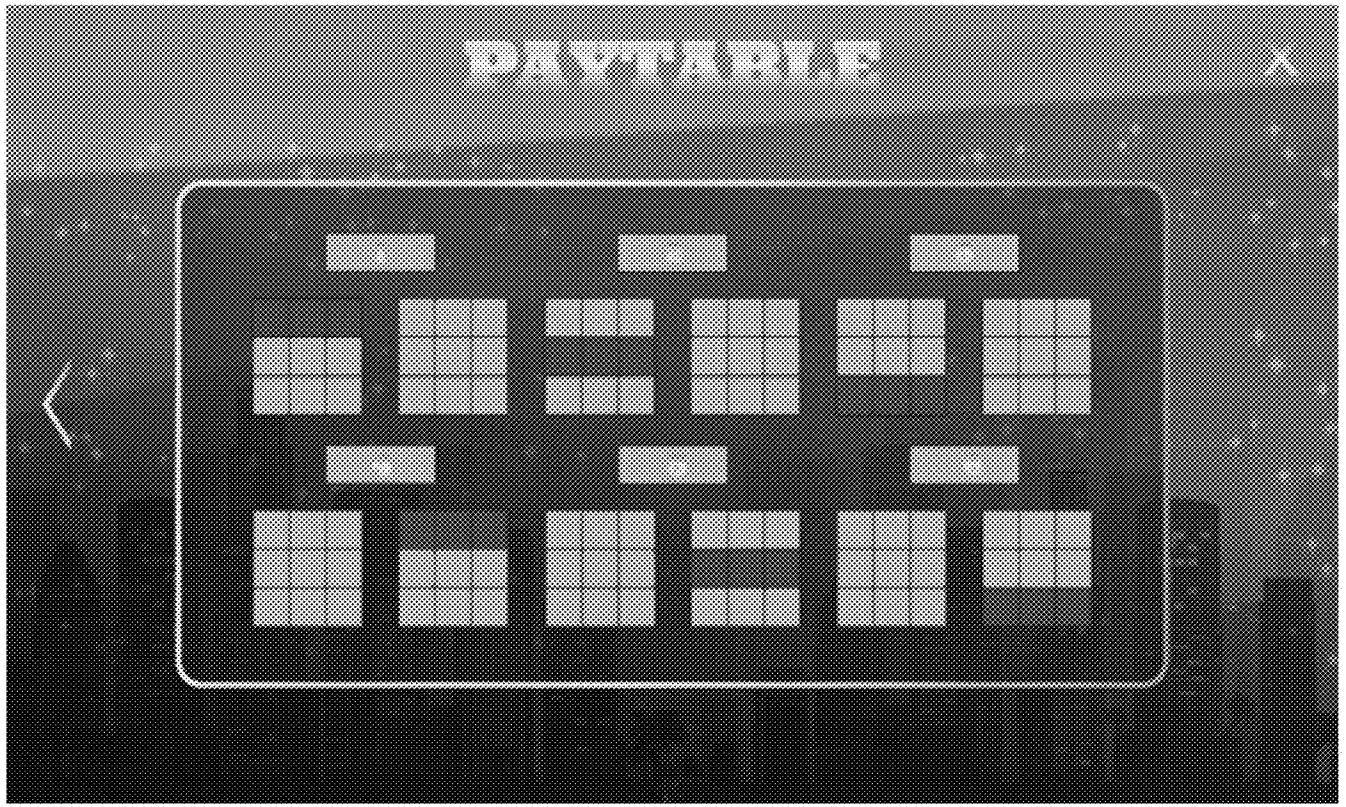
FIG. 9B is illustrative of a paytable of a game described herein.

FIGS. 9B and 9C show the corresponding paytable payout-lines and winnings tables respectively.

Figure 10A:
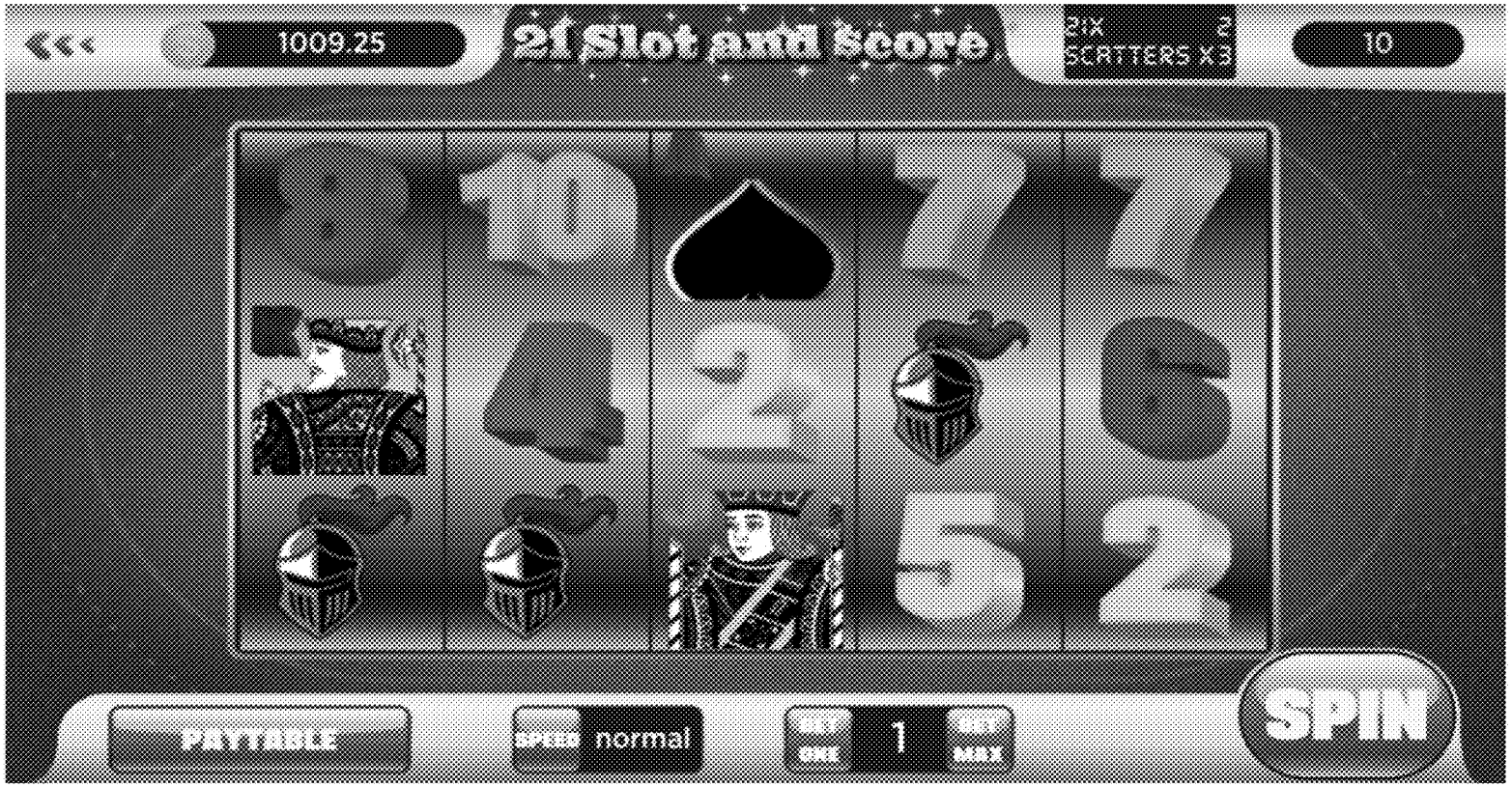
FIG. 10A is illustrative of an inventive interface layout of a game described herein.
Figure 10B:
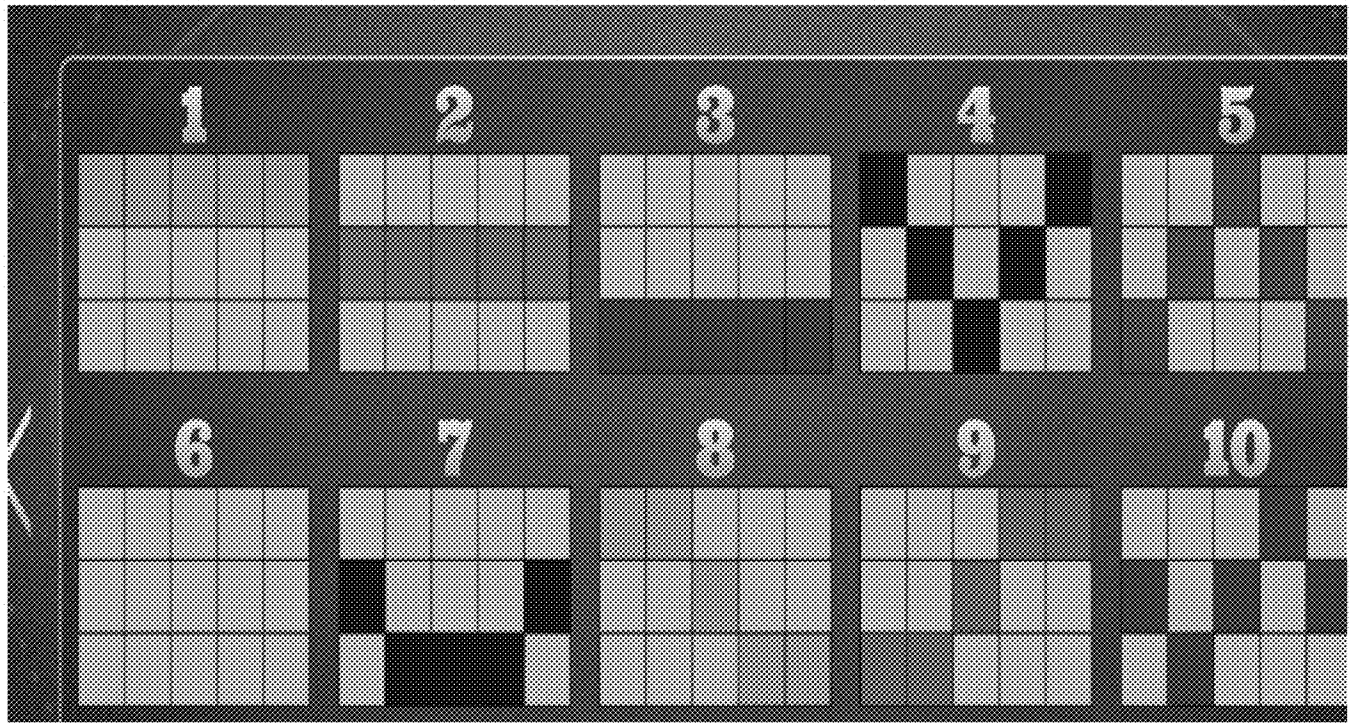
FIG. 10B is illustrative of a paytable of a game described herein.
Figure 10C:
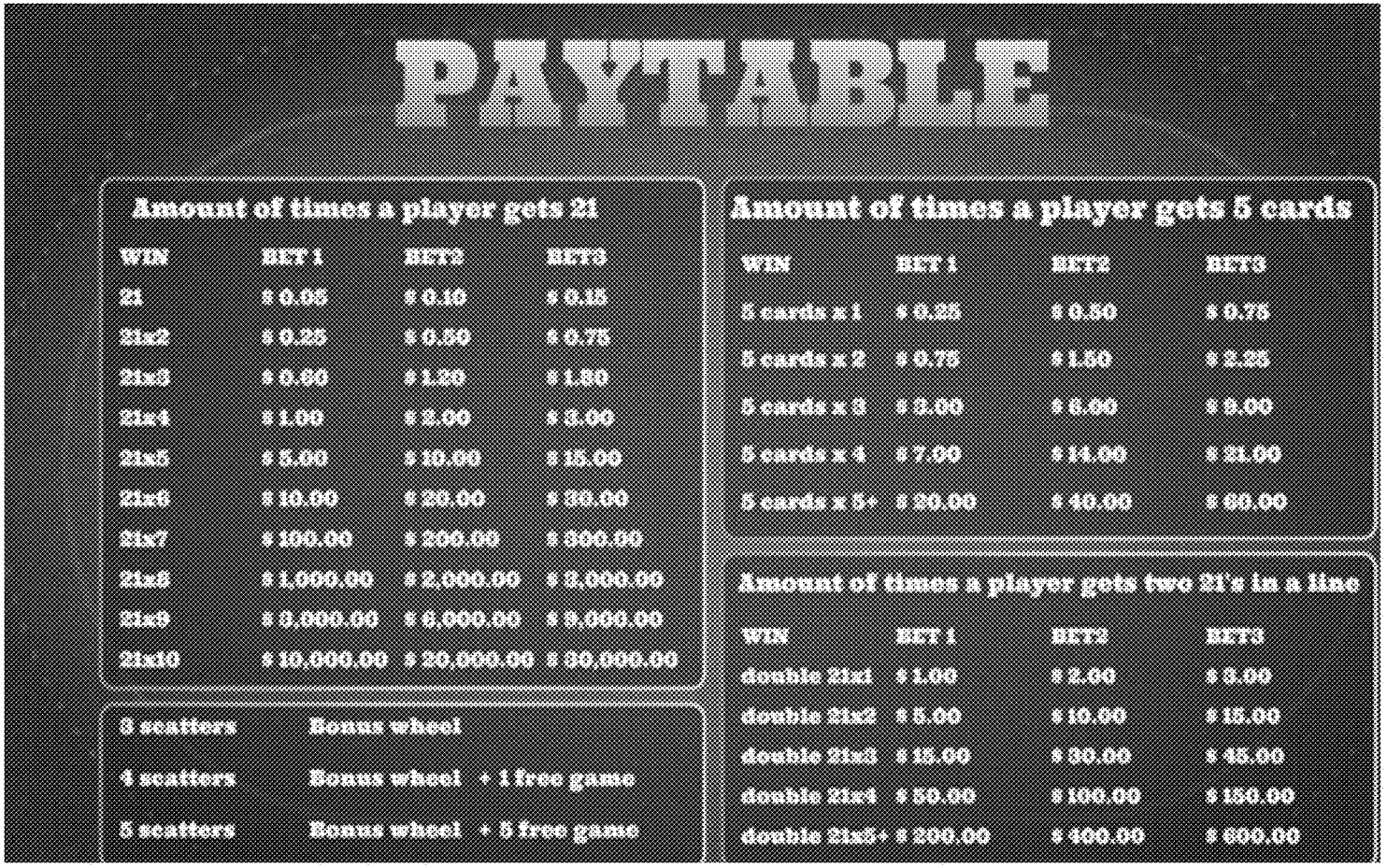
FIG. 10C is illustrative of a paytable of a game described herein.

FIG. 10A is a similar game called "21 Slot and Score." In this game there are ten different paylines that are calculated from left to right. For example in FIG. 10B paylines 4 through 10 use actuation locations in a non-linear sequential order. The rules for calculating 21 and double 21 are the same as in the game in 6A. Here there is an extra symbol, in this game the symbol does not go towards the five cards so if a player had (3,4,2,4,Scatter) within a payline it would not be counted as 5 cards. The difference between this game and the one in 6A is that winning combinations are exclusive to each other, i.e. if a player has 21 they would receive a payout of 0.05 for a $1 bet and increases substantially to $10,000 for having a 21 value ten times. Likewise, the five card combinations are also counted separately and increase from 0.25 for one five card line to $20 to five "five card" lines. Double 21's also increase cumulatively from $1.00 for one "double 21" to $200.00 for two double 21's. In this game, there is also a scatter symbol. If a player has three scatters a bonus round is initiated where multiples of their bet can be won. If a player has four scatter symbols a free spin is also awarded and if there are five scatters five free spins are awarded.

Though the games in FIGS. 8 and 9A have five variables horizontally it can also be played with more like 6, 7, 8, 9 or 10 variables with triple or quadruple 21's. Though this has 3 horizontal lines down these games can be played with more. The game in 10A has a single symbol though game could also contain a plurality of symbols exclusive from a card deck, Though in this game a player does not receive points for matching cards or symbols within a pay line there could be. For example, a paytable could contain a payout for $100 for matching 5 aces or five scatters within a payline.

Figure 11A:
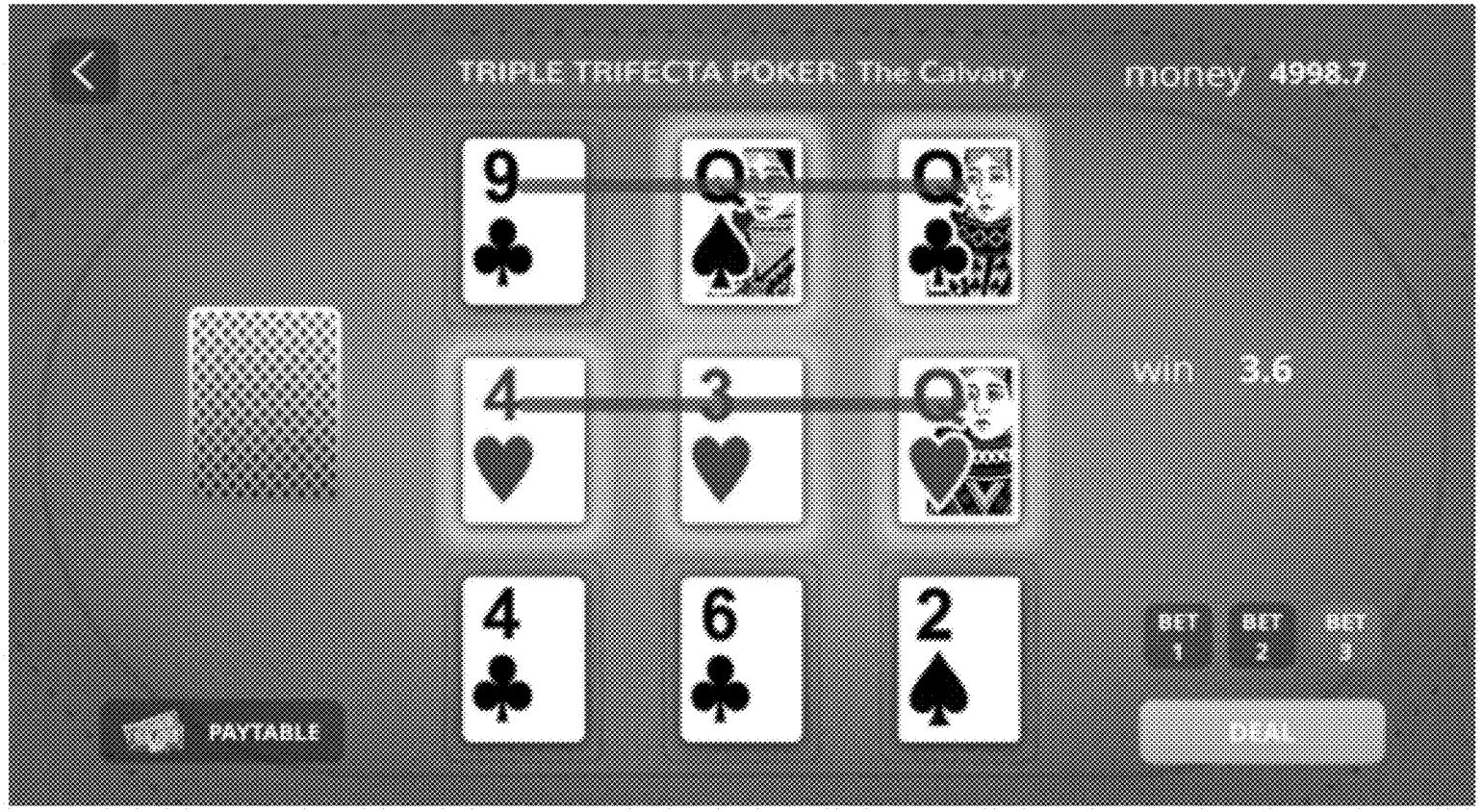
FIG. 11A is illustrative of an inventive interface layout of a game described herein.
Figure 11B:
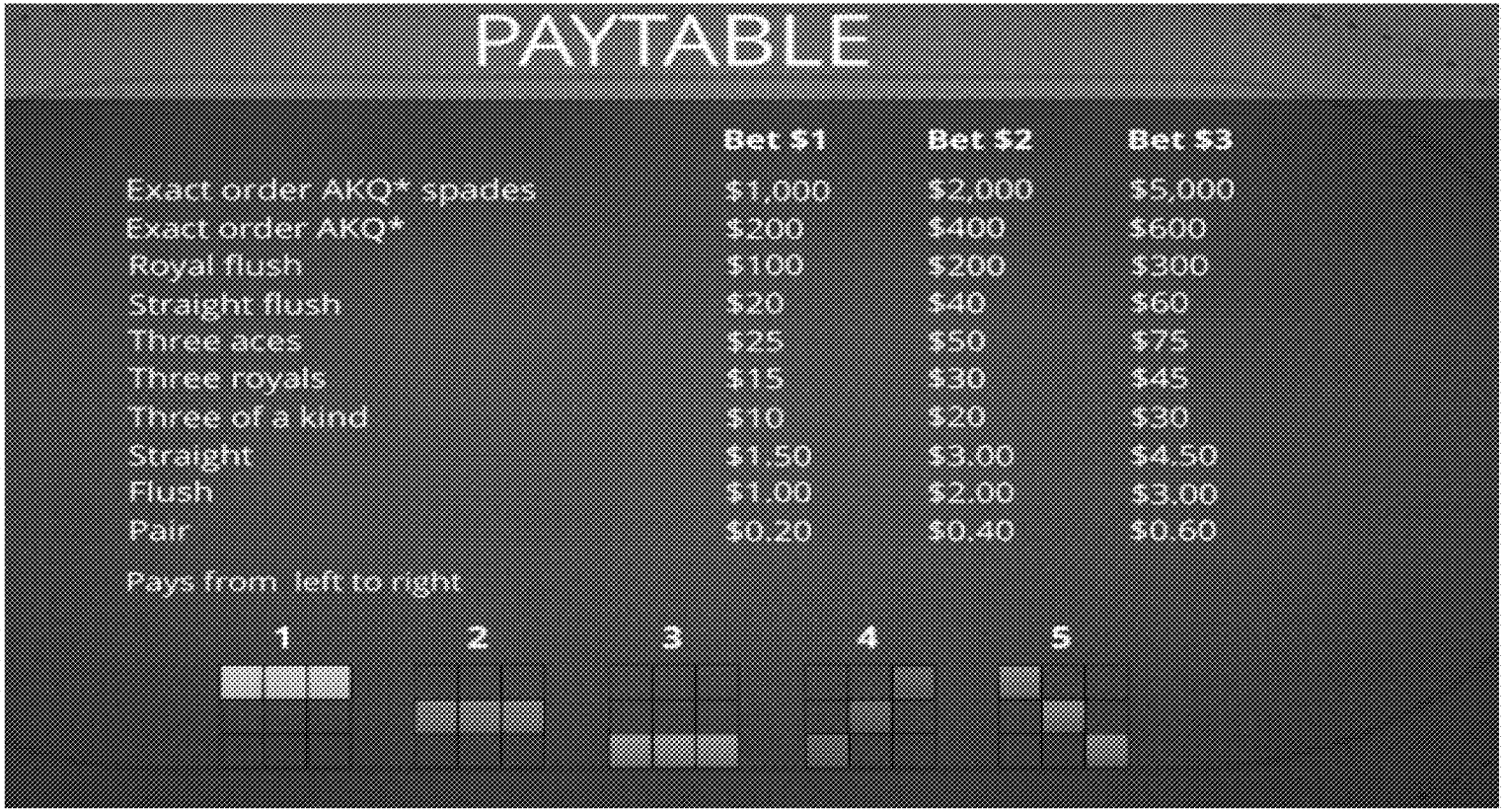
FIG. 11B is illustrative of a paytable of a game described herein.

FIG. 11A is game the "TripleTrifecta Poker". There are 5 pay lines. Three horizontal lines and two diagonal lines. A player gets awarded for having poker hands within a payline. There is a high payout for having a three-card royal flush in a specific suit in this case spades and in a specific sequence, in this game from left to right i.e. ABC. FIG. 11B shows the paytable for FIG. 11A.

Figure 12A:
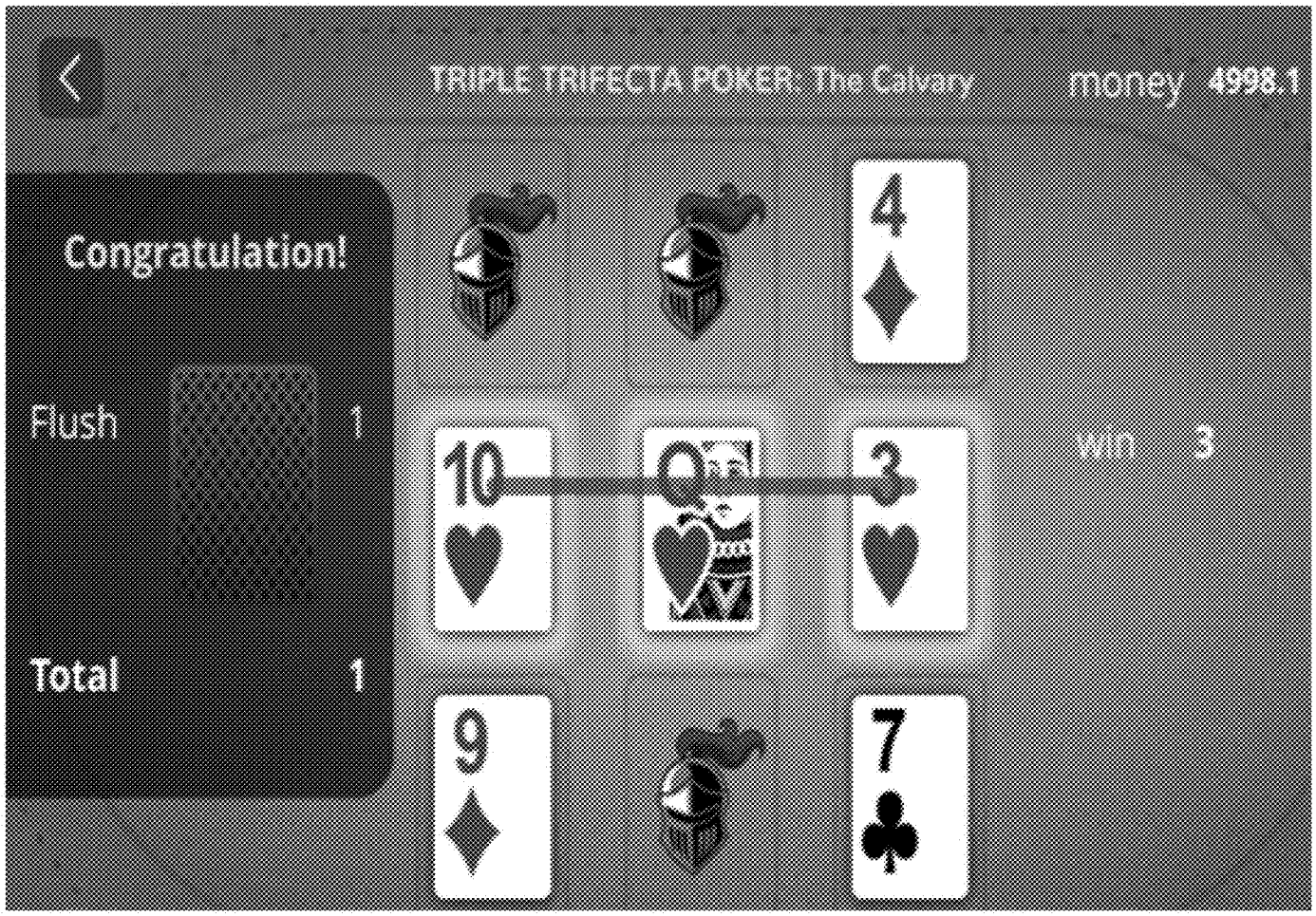
FIG. 12A is illustrative of an inventive interface layout of a game described herein.
Figure 12B:
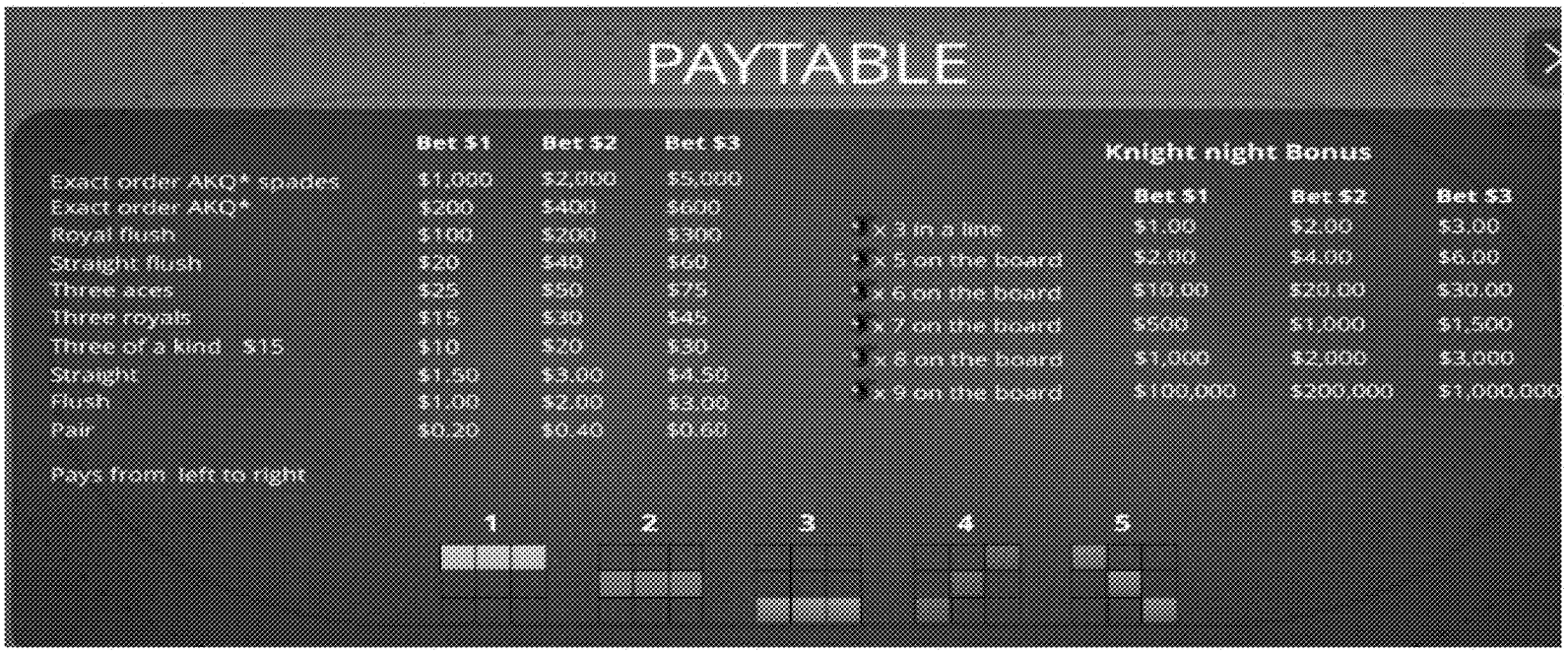
FIG. 12B is illustrative of a paytable of a game described herein.

FIG. 12A is the game "Triple trifecta: The calvary." Here there are ten symbols added to the deck though there could be more than one symbol added that are exclusive from a card deck. A player is awarded a prize if they have 3 of the symbol within a payline. A player could also receive a payout for having a plurality of the symbols shown on a board. Here If there are five symbols on the board a player would receive a $2.00 credit, six symbols a $10.00 credit and $100,000 credit for having all spaces contain the symbol. FIG. 12C is another 3×3 poker game with a doubleline bonus where a poker hand from best two paylines lines are used to calculate a payout. The gaming system could also have a progressive payout for obtaining a high poker hand from five or six cards. FIG. 12D is a pay table that uses the entire board to calculate the best hands, nine, eight or seven of the cards on the board is used to make a determination if a player has won.

Figure 13A:
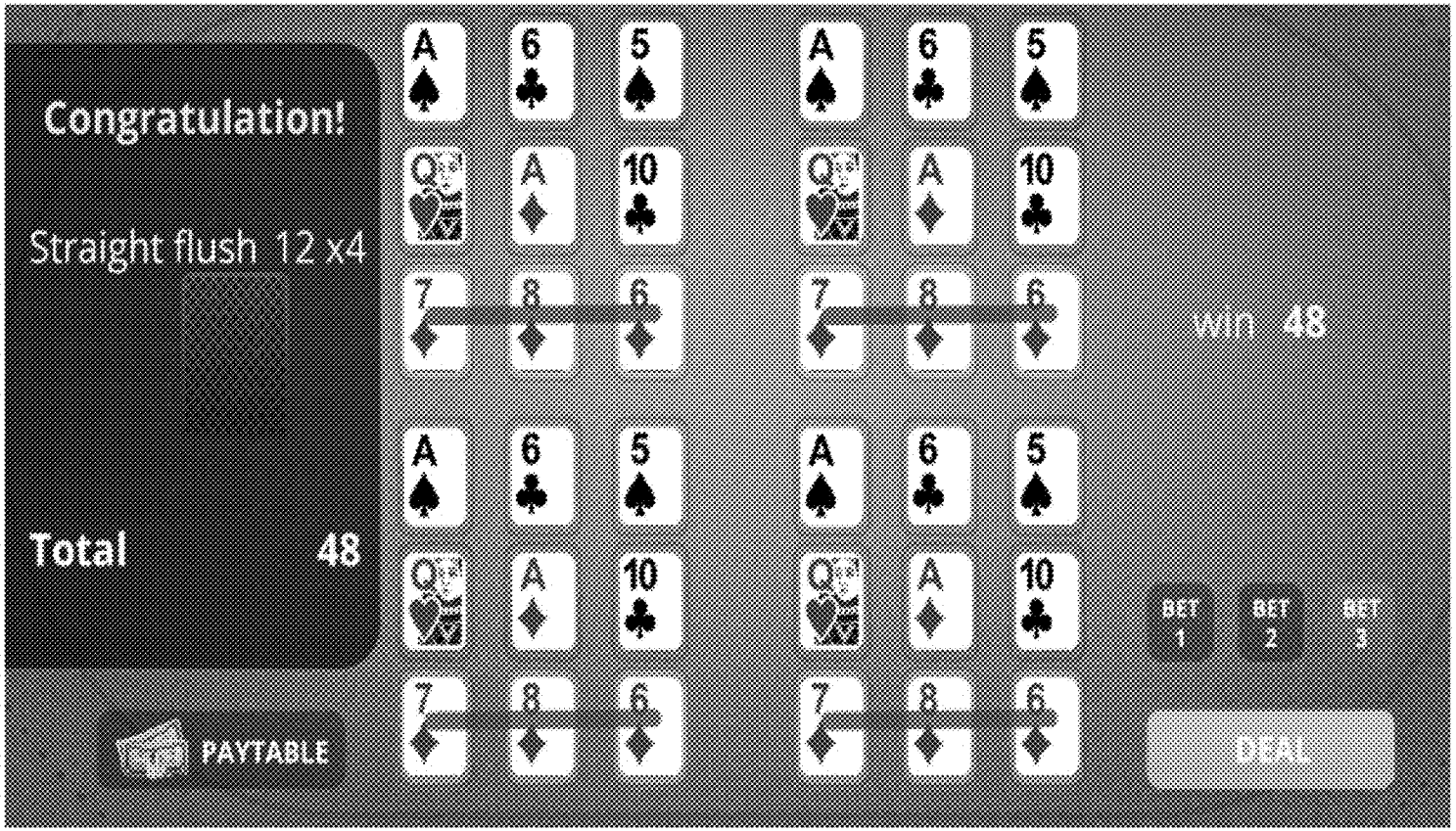
FIG. 13A is illustrative of an inventive interface layout of a game described herein.
Figure 13C:
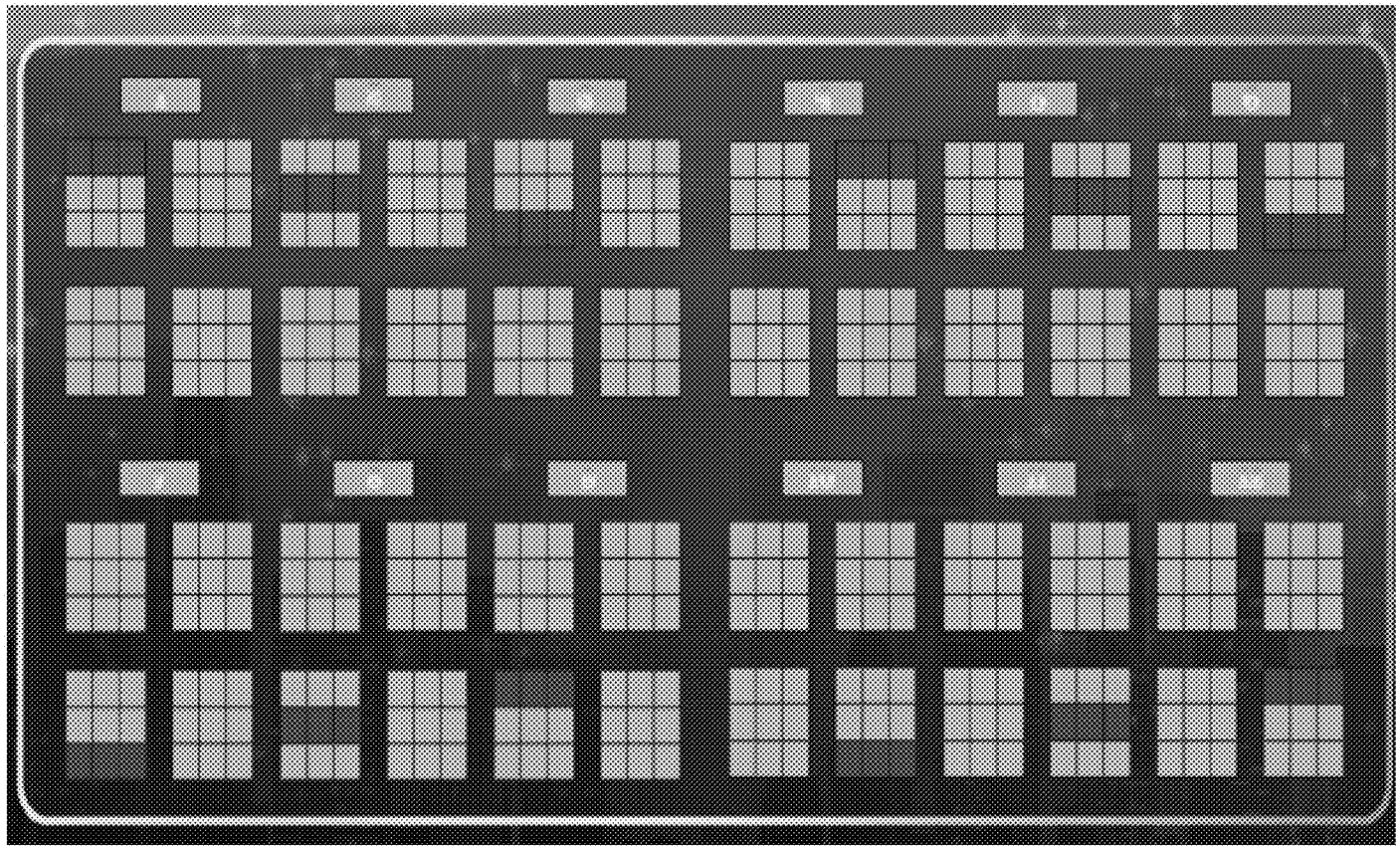
FIG. 13C is illustrative of a paytable of a game described herein.

FIG. 13A is Supertrifecta poker; A player wagers; $1.20, $2.40 or $3.00 a player gets free lines for betting more. The bet for 10 lines is reduced like to $3.00 as to give players more incentive to bet the maximum amount. Having four separate grids is more dazzling and stimulating to the eye than having one. The setup corresponds to the aforementioned table II. The objective qualifying card poker hand with the highest payout A,KQ in exact order with the suit of spades. The awards in all these games can be progressives that is they increase gradually every time a player does not achieve the highest objectives. In FIG. 13, a player wagered $3.00 and they received four straight flushes for a total winning of $144.

Having thus described several embodiments for practicing the inventive method, its advantages and objectives can be easily understood. Variations from the description above may and can be made by one skilled in the art without departing from the scope of the invention.

Accordingly, this invention is not to be limited by the embodiments as described, which are given by way of example only and not by way of limitation.

What is claimed is:

1. An electronic gaming system dedicated to playing a regulated wagering game, comprising:

at least one display device;

at least one processor; and at least one memory device which stores a plurality of instructions, which when executed by the at least one processor, cause the at least one processor to:

(a) display a player interface on the at least one display device, the player interface having a slot based visual representation including at least three actuation result locations based upon selections from a "playing card" deck and at least one module indicating a win actuation result location;

(b) upon actuation, update the at least three actuation result locations on the at least one display device based at least in part upon the output of a randomized number generator and at least one rule set;

(c) calculate a point score based on the rule set if the at least three actuation result locations comprise a value that is twenty-one (21) counting in sequential order across the at least one module; and (d) update an account based upon the point score, wherein if the sequential values in a module total more than twenty-one (21) or are exactly twenty-one, a new sequence begins at the next sequential actuation result location allowing the possibility of two or more twenty-one (21) values within the module.

2. The system of claim 1, further comprising at least one input device, wherein the at least one input device is configured to accept real money or virtual money and is configured to accept a wager.

3. The system of claim 1, wherein the point score is determined according to a predetermined table, wherein the point score designates a credit to the account, wherein the rotary reel based visual representation includes at least fifteen actuation result locations and at least three modules wherein the at least one rule set is to have a twenty-one objective that uses numerical values based upon the Blackjack or Twenty-One card game.

4. The system of claim 1, wherein the account is a player account or game account.

5. The system of claim 1, wherein the point score is based on the cumulative twenty-one (21) values across all of the modules.

6. The system of claim 1, wherein the point score is credited for having the at least three actuation result locations total less than twenty-one (21).

7. The system of claim 1, wherein the rotary reel based visual representation includes at least six actuation result locations and wherein the at least one rule set is based upon the card game Poker.

8. A gaming input device apparatus comprising:

the gaming system of claim 1;

a wager input device; and a cash out device, wherein a payout is awarded to a player if they have exactly a twenty-one (21) value sequentially from left to right in a module from the starting point.

9. The system of claim 1 wherein the at least one rule set includes criteria for determining the account deficit or asset based at least in part upon the player actuation results.

10. The system of claim 1 wherein the at least one rule set includes criteria for determining the account bonus based at least in part upon the player actuation results.

11. A wager input system for a game on an electronic gaming device, the wager input system comprising:

at least one display device;

at least one processor; and at least one memory device which stores a plurality of instructions, which when executed by the at least one processor, cause the at least one processor to:

(a) display on the at least one display device, a player interface having at least two non-intersecting modules from a game of three card poker; and (b) a rule set based on a calculation of a point score if the at least three actuation result locations comprise a value, wherein if the subsequent values in a module total more than twenty-one (21) or are exactly twenty-one, a new sequence begins at the next subsequent actuation result location allowing the possibility of two or more twenty-one (21) values within the modules.

12. The wager input system of claim 11, further comprising a pay-table that specifically indicates a high payout of Ace King Queen in a specific sequence of a specific suit.

13. The wager input system of claim 12, wherein the pay-table has a high payout that involves a symbol that is not from a 52-card deck.

14. The wager input system of claim 11, wherein the at least one display device has an interface and wherein the interface has four quadrants (I, II , III and IV) with each quadrant having at least two non-intersecting pay lines.

15. A method of playing a multi-zone blackjack game on an electronic gaming device, the method comprising:

providing an electronic gaming device having a wager input device that accepts vouchers and physical currency, a processor, and a controller, wherein the controller controls an electronic game of multi-zone blackjack, wherein the electronic game of multi-zone blackjack includes at least three zones;

initiating the game via the processor on the electronic gaming device, the game involving:

a) receiving via the processor an initial wager from a player;

b) revealing, by the electronic gaming device, a blackjack card to a player;

c) receiving an input from the player regarding which zone area to place the blackjack card in;

d) repeating, by the electronic gaming device, steps (b)-(c) until the total value of the cards in each of the three or more zones is twenty-one (21) or greater than twenty-one (21); and e) determining via the processor whether the player is entitled to a payout if the player achieves a value of twenty-one (21) in at least one of the three or more zones or if five cards having a total value of twenty-one (21) or less is in at least one of the three or more zones, wherein if the sequential values in a module total more than twenty-one (21) or are exactly twenty-one, a new sequence begins at the next sequential actuation result location allowing the possibility of two or more twenty-one (21) values within the module.

16. The method of claim 15, wherein the at least three or more zones includes a fourth zones and a fifth zone.

17. The method of claim 15, wherein the at least three or more zones are non-intersecting.

18. The method of claim 15, wherein a cumulative award is provided if the player achieves a value of twenty-one (21) or five cards having a total value of twenty-one (21) or less in at least two of the three or more zones.

19. A regulated wagering system, comprising:

at least one display surface;

at least one processor; and at least one memory device which stores a plurality of instructions, which when executed by the at least one processor, cause the at least one processor to:

(a) display a player interface on the at least one display device, the player interface having a slot based visual representation including at least three actuation result locations based upon selections from a "playing card" deck and at least one module indicating a win actuation result location;

(b) upon actuation, update the at least three actuation result locations on the at least one display device based at least in part upon the output of a randomized number generator and at least one rule set;

(c) calculate a point score based on the rule set if the at least three actuation result locations comprise a value that is twenty-one (21) counting in sequential order across the at least one module; and (d) update an account based upon the point score, wherein if the sequential values in a module total more than twenty-one (21) or are exactly twenty-one, a new sequence begins at the next sequential actuation result location allowing the possibility of two or more twenty-one (21) values within the module.

20. A method of executing a regulated wagering game, comprising:

providing a game with at least one display surface area, the at least one display surface comprising a player interface on the at least one display surface, the player interface having a "playing deck" based indicia including at least three actuation result locations based upon selections from a "playing card" deck and at least one module indicating a win actuation result location;

actuating the at least three actuation result locations on the at least one display surface based at least in part upon at least one rule set;

calculating a point score based on the rule set if the at least three actuation result locations comprise a value that is twenty-one (21) across the at least one module; and determining a win amount based on the point amount is stored on the systems memory, wherein if the sequential values in a module total more than twenty-one (21) or are exactly twenty-one, a new sequence begins at the next sequential actuation result location allowing the possibility of two or more twenty-one (21) values within the module.

21. The method of claim 20, further comprising providing an electronic mechanism configured to detect a physical item associated with a monetary value that determines the objects valuation upon interfacing with a physical object.

* * * * *